US011661091B2

(12) United States Patent
Deel et al.

(10) Patent No.: US 11,661,091 B2
(45) Date of Patent: May 30, 2023

(54) LINE BYPASS SYSTEM

(71) Applicant: PREFORMED LINE PRODUCTS CO., Mayfield Village, OH (US)

(72) Inventors: Adam Deel, Bay Village, OH (US); Randy Cloud, Mentor, OH (US)

(73) Assignee: PREFORMED LINE PRODUCTS CO., Mayfield Village, OH (US)

( * ) Notice: Subject to any disclaimer, the term of this patent is extended or adjusted under 35 U.S.C. 154(b) by 250 days.

(21) Appl. No.: 16/807,155

(22) Filed: Mar. 2, 2020

(65) Prior Publication Data

US 2020/0198662 A1 Jun. 25, 2020

Related U.S. Application Data

(60) Continuation-in-part of application No. 15/424,773, filed on Feb. 3, 2017, now Pat. No. 10,576,996, which is a division of application No. 14/217,341, filed on Mar. 17, 2014, now Pat. No. 9,573,602.

(60) Provisional application No. 61/801,413, filed on Mar. 15, 2013.

(51) Int. Cl.
*B61B 7/00* (2006.01)

(52) U.S. Cl.
CPC ..... *B61B 7/00* (2013.01); *Y10S 901/01* (2013.01); *Y10S 901/44* (2013.01)

(58) Field of Classification Search
CPC . B60M 1/24; B60M 1/20; B60M 1/34; B60M 1/23; B60M 1/12; B60M 1/225; B60M 1/305; B60M 1/307; B60M 1/13; B60M 1/30; B60M 5/00; B60M 1/22; B60M 1/234; B60M 1/14; B60M 7/00; E01B 25/24; B61B 7/06; B61B 3/02; B61B 7/00; B61B 12/026; Y10S 901/01; Y10S 901/44; F16G 11/12; F16G 11/046; H02G 7/14
See application file for complete search history.

(56) References Cited

U.S. PATENT DOCUMENTS 1,902,009 A * 3/1933 Arthur ..... H02G 7/14 248/63
2,722,393 A * 11/1955 Peterson ..... H02G 7/14 248/63
3,397,857 A * 8/1968 Schlein ..... E04H 12/00 174/DIG. 12
3,506,228 A * 4/1970 Johnson ..... F16L 3/10 248/63
3,539,139 A * 11/1970 Eucker ..... H02G 7/14 248/63

(Continued)

FOREIGN PATENT DOCUMENTS

GB 107636 A * 7/1917 ..... F16G 11/048

*Primary Examiner* — Mark T Le
(74) *Attorney, Agent, or Firm* — Cooper Legal Group, LLC

(57) ABSTRACT

A line bypass system includes a support structure including a first support portion and a second support portion spaced apart from the first support portion. The support structure includes an attachment portion that attaches the first support portion to the second support portion. The first support portion and the second support portion define a first opening on a first side of the attachment portion and a second opening on a second side of the attachment portion. The first opening movably receives a first guide wire and the second opening movably receives a second guide wire.

20 Claims, 26 Drawing Sheets

(56) References Cited

U.S. PATENT DOCUMENTS

| | | | | |
|---|---|---|---|---|
| 4,718,788 | A * | 1/1988 | Briscoe | F16G 11/046 403/211 |
| 6,135,398 | A * | 10/2000 | Quesnel | G02B 6/4471 248/74.1 |
| 10,576,996 | B2 * | 3/2020 | Deel | B61B 7/00 |
| 2003/0122040 | A1 * | 7/2003 | Pisczak | G02B 6/483 248/74.1 |

* cited by examiner

LINE BYPASS SYSTEM

CROSS-REFERENCE TO RELATED APPLICATIONS

This application is a continuation-in-part of and claims priority to U.S. Non-Provisional patent application Ser. No. 15/424,773, filed on Feb. 3, 2017, which claimed priority to U.S. Non-Provisional patent application Ser. No. 14/217,341 filed on Mar. 17, 2014, which claimed priority to U.S. Provisional Patent Application No. 61/801,413, filed on Mar. 15, 2013, all entitled "LINE BYPASS SYSTEM," all of which are hereby incorporated by reference herein.

TECHNICAL FIELD

The instant application is generally directed towards a line bypass system. For example, the instant application is directed towards a support structure for a line bypass system that allows for a robot to bypass the support structure.

BACKGROUND

Robots can be supported on overhead electric transmission lines, with the robots moving along the lines during inspection. Robots can be used for inspecting transmission line components, right of way conditions, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a line bypass system comprises a support structure comprising a first support portion and a second support portion spaced apart from the first support portion. An attachment portion is configured to attach the first support portion to the second support portion. The first support portion and the second support portion define a first opening on a first side of the attachment portion and a second opening on a second side of the attachment portion. The first opening is configured to movably receive a first guide wire and the second opening is configured to movably receive a second guide wire.

In an example, a line bypass system comprises a support structure comprising a first support portion and a second support portion spaced apart from the first support portion. An attachment portion is configured to attach the first support portion to the second support portion. The first support portion and the second support portion define a first opening on a first side of the attachment portion and a second opening on a second side of the attachment portion. The first opening is configured to movably receive a first guide wire and the second opening is configured to movably receive a second guide wire. A first connecting structure extends between the first support portion and the second support portion. The first connecting structure is spaced apart from the attachment portion to define the first opening.

In an example, a line bypass system comprises a support structure comprising a first support portion and a second support portion spaced apart from the first support portion. An attachment portion is configured to attach the first support portion to the second support portion. The first support portion and the second support portion define a first opening on a first side of the attachment portion and a second opening on a second side of the attachment portion. The first opening is configured to movably receive a first guide wire and the second opening is configured to movably receive a second guide wire. A first guide device is attached to at least one of the first support portion or the second support portion. The first guide device defines a first channel into which a first wire portion of the first guide wire is received.

The following description and annexed drawings set forth certain illustrative aspects and implementations. These are indicative of but a few of the various ways in which one or more aspects can be employed. Other aspects, advantages, and novel features of the disclosure will become apparent from the following detailed description when considered in conjunction with the annexed drawings.

DETAILED DESCRIPTION

Figure 1:
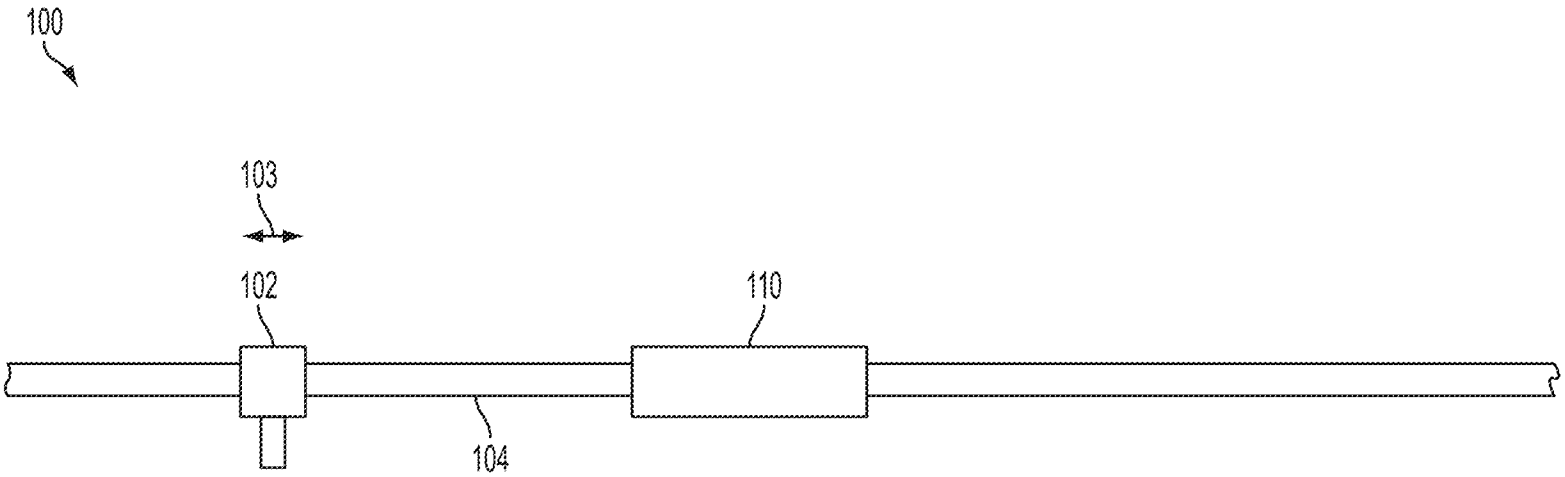
FIG. 1 illustrates an example line bypass system.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Turning to FIG. 1, an example line bypass system 100 is illustrated. The line bypass system 100 is illustrated generically/schematically, as the line bypass system 100 includes any number of structures, configurations, constructions, etc., some of which are described/illustrated with respect to FIGS. 2 to 9. In general, a robot 102 may traverse 103 (e.g., illustrated generically with movement lines) along an overhead transmission line (e.g., shield wire 104) to collect information regarding the lines (e.g., shield wire 104), structures, right of way/obstructions, etc. In some examples, the robot 102 can detect/identify vegetation, right of way encroachment, line problems, etc. using a variety of inspection technologies.

It will be appreciated that the term "bypass" used here (e.g., with respect to the line bypass system 100, for example) is a broad term that is not limited to directing the robot 102 from one line to another line (e.g., from a shield wire to a bridge, for example). Indeed, the term "bypass" may include diverting/directing the robot 102 from a first line (e.g., shield wire) to a second line (e.g., bridge) and/or from the second line (e.g., bridge) back to the first line (e.g., shield wire), such as in the examples illustrated in FIGS. 5-7. In addition, the term "bypass" may also include examples in which the robot 102 traverses and/or passes over a support structure (e.g., hardware) while remaining on a single line (e.g., the shield wire or the bridge) and not having to disengage from that single line, such as in the examples illustrated in FIGS. 1 to 4.

The shield wire 104 is illustrated generically/schematically and may include any number of constructions. In general, the shield wire 104 may comprise an electrically conductive or non-conductive wire, cable, line, rope, fiber, fiber optic, etc. The shield wire 104 may include any number of materials including metal materials (e.g., conductors), non-metal materials (plastics, composite materials, etc.), or the like, that may or may not be implemented to provide utility services and/or products. The shield wire 104 can support the robot 102 such that the robot 102 can move/traverse 103 along the shield wire 104. In some examples, the shield wire 104 can provide a pathway onto and off of the system as well.

The line bypass system 100 may include a support structure 110. The support structure 110 is illustrated generically/schematically in FIG. 1, as the support structure 110 includes a number of different constructions/configurations, some of which are illustrated in FIGS. 2 to 9. In general, the support structure 110 includes any number of functions. For example, the support structure 110 can support/hold the shield wire 104 in a suspended manner while the support structure 110 is held/supported, such as by a utility pole/structure or the like. As such, in an example, the support structure 110 can assist in holding/supporting the shield wire 104 at an elevated position.

Figure 2A:
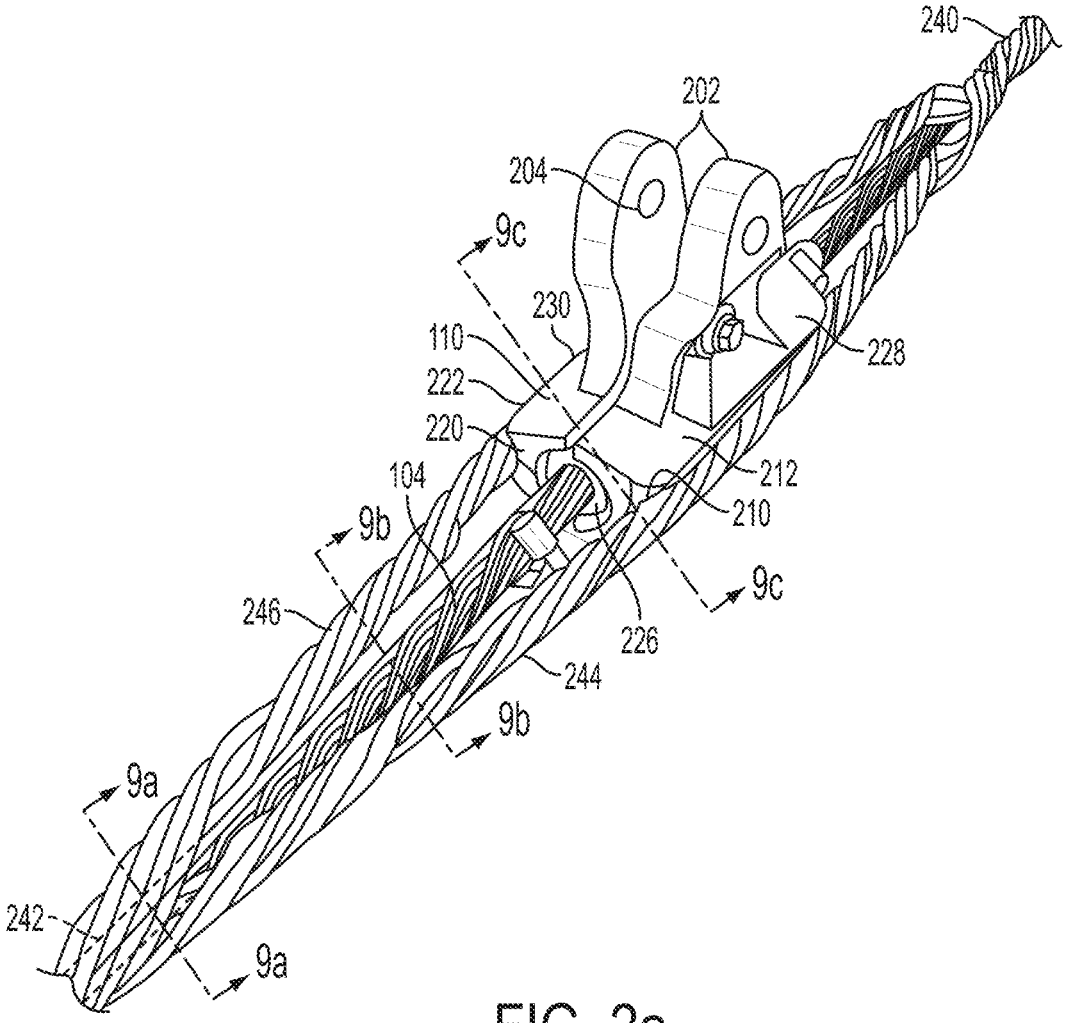
FIG. 2*a* illustrates an example support structure.
Figure 2B:
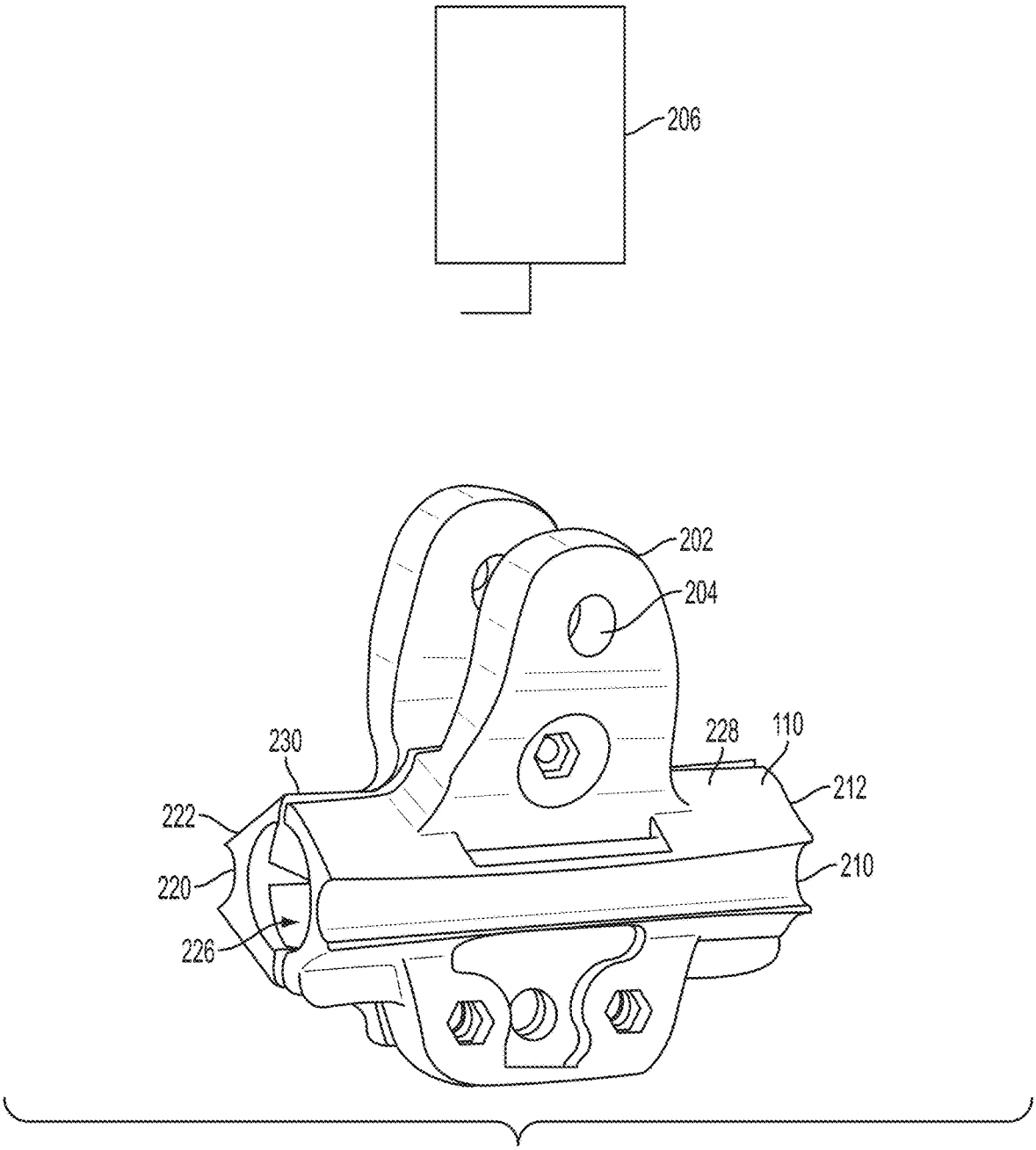
FIG. 2*b* illustrates an example support structure.

Turning to FIGS. 2*a* and 2*b*, an example of the support structure 110 is illustrated. The support structure 110 can be provided along the shield wire 104 such that the support structure 110 can support and/or receive the shield wire 104. The support structure 110 comprises any number of materials, including metals, plastics, composite materials, or the like. In an example, the support structure 110 has at least some degree of rigidity/stiffness so as to support and/or receive the shield wire 104, the robot 102, etc.

The support structure 110 comprises an attachment structure 202. The attachment structure 202 may be located at an upper side of the support structure 110. The attachment structure 202 may include an attachment opening 204 through which an attachment device can be inserted. In an example, the attachment structure 202 can attach to a suspension device 206 such that the support structure 110 is supported below the suspension device 206. In a possible example, a portion of the suspension device 206 may be inserted through the attachment opening 204 such that the suspension device 206 can hold/attach/support the attachment structure 202.

It will be appreciated that the suspension device 206 is illustrated generically/schematically for illustrative purposes. Indeed, the suspension device 206 is intended to illustrate a possible position of the suspension device 206 with respect to the support structure 110. In other examples, however, the suspension device 206 comprises any number of configurations, sizes, structures, constructions, etc. In general, the suspension device 206 can be directly or indirectly attached to a utility structure, such that the support structure 110 may be suspended and held by the suspension device 206. It will be appreciated that the suspension device 206 may or may not be included as part of the system (e.g., line bypass system 100). Indeed, in some examples, the suspension device 206 may include an arm, fitting, or the like to suspend the support structure 110.

The support structure 110 defines a first channel 210 disposed on a first lateral side 212 of the support structure 110 and a second channel 220 disposed on a second lateral side 222 of the support structure 110. In some examples, the second channel 220 extends parallel to the first channel 210. In such an example, the first channel 210 and the second channel 220 can extend in a direction that is generally perpendicular with respect to a direction along which the suspension device 206 extends. The first channel 210 and the second channel 220 can extend substantially along an entire length of the support structure 110, with the first channel 210 and the second channel 220 each defining a groove, furrow, opening, indentation, or the like into the support structure 110. In at least one example, the first channel 210 and the second channel 220 each have an outer side that is substantially open (e.g., not bordered) while an inner side is bordered by the support structure 110.

The support structure 110 defines a third channel 226 into which the shield wire 104 is received. The third channel 226 may be sized/shaped to receive the shield wire 104. For example, the third channel 226 may have a cross-sectional size that is slightly larger than a cross-sectional size of the shield wire 104 such that the shield wire 104 can be received and extend through the third channel 226. In the illustrated example, the third channel 226 extends substantially parallel to the first channel 210 and the second channel 220. The third channel 226 may be disposed/positioned between the first channel 210 and the second channel 220. In contrast to the first channel 210 and the second channel 220, the third channel 226 may define a substantially continuous circumferential boundary around the shield wire 104, such that the shield wire 104 is generally limited from being inadvertently removed from the third channel 226.

The shield wire 104 can be inserted into the support structure 110 in any number of ways. In one possible example, the support structure 110 comprises a plurality of portions (e.g., a first portion 228 and a second portion 230), with the first portion 228 and the second portion 230 being selectively attachable to each other, such as with mechanical fasteners or the like. In such an example, the first portion 228 and the second portion 230 can be detached from each other to allow for the shield wire 104 to be positioned within the third channel 226. Upon the shield wire's 104 insertion, the first portion 228 and the second portion 230 may be reattached to each other, such that the shield wire 104 is limited from being inadvertently removed from the third channel 226.

A guide wire 240 may be provided for attaching to the shield wire 104. In an example, the guide wire 240 defines a guide wire opening 242 into which the shield wire 104 is received. The guide wire opening 242 extends axially along the guide wire 240 and is sized to receive the shield wire 104. While the guide wire 240 comprises any number of constructions, in this example, the guide wire 240 has a braided design comprising a plurality of uniformly wrapped strands. It will be appreciated that the braided design (e.g., uniformly wrapped strands) of the guide wire 240 comprises one or more individual strands shaped in a similar or identical pattern that may, in some examples, resemble a stretched spring or helix. This allows for the guide wire 240 to secure/attach to the shield wire 104 and provide proper stiffness to support the compression at the robot interface. As such, in some examples, the guide wire 240 may include a plurality of wire portions, such as a first wire portion 244 and a second wire portion 246. The first wire portion 244 and the second wire portion 246, together comprising the guide wire 240, can be braided/attached to define the guide wire opening 242 into which the shield wire 104 is received.

The first wire portion 244 and the second wire portion 246 can be unwrapped/detached, as illustrated in FIG. 2*a*, to accommodate for the support structure 110. For example, the first wire portion 244 and the second wire portion 246 can be spaced apart with the shield wire 104 extending therebetween. The first wire portion 244 of the guide wire 240 can be received in the first channel 210. The second wire portion 246 of the guide wire 240 can be received in the second channel 220. In this example, the support structure 110 is sandwiched between the first wire portion 244 (in the first channel 210) and the second wire portion 246 (in the second channel 220), such that the first wire portion 244 and the second wire portion 246 are generally fixed with respect to the support structure 110.

In this example, the first wire portion 244 and the second wire portion 246 are unwrapped and spaced apart on the first lateral side 212 and the second lateral side 222 of the support structure 110. Extending farther away from the support structure 110, the first wire portion 244 and the second wire portion 246 can be braided/attached to define the guide wire opening 242. Similarly, extending farther away from the support structure 110 on an opposite side of the support structure 110, the first wire portion 244 and the second wire portion 246 can be braided/attached to define the guide wire opening 242. As will be described with respect to FIGS. 8 and 9, the robot 102 can traverse/bypass the support structure 110 while traversing/moving along the shield wire 104.

Figure 2C:
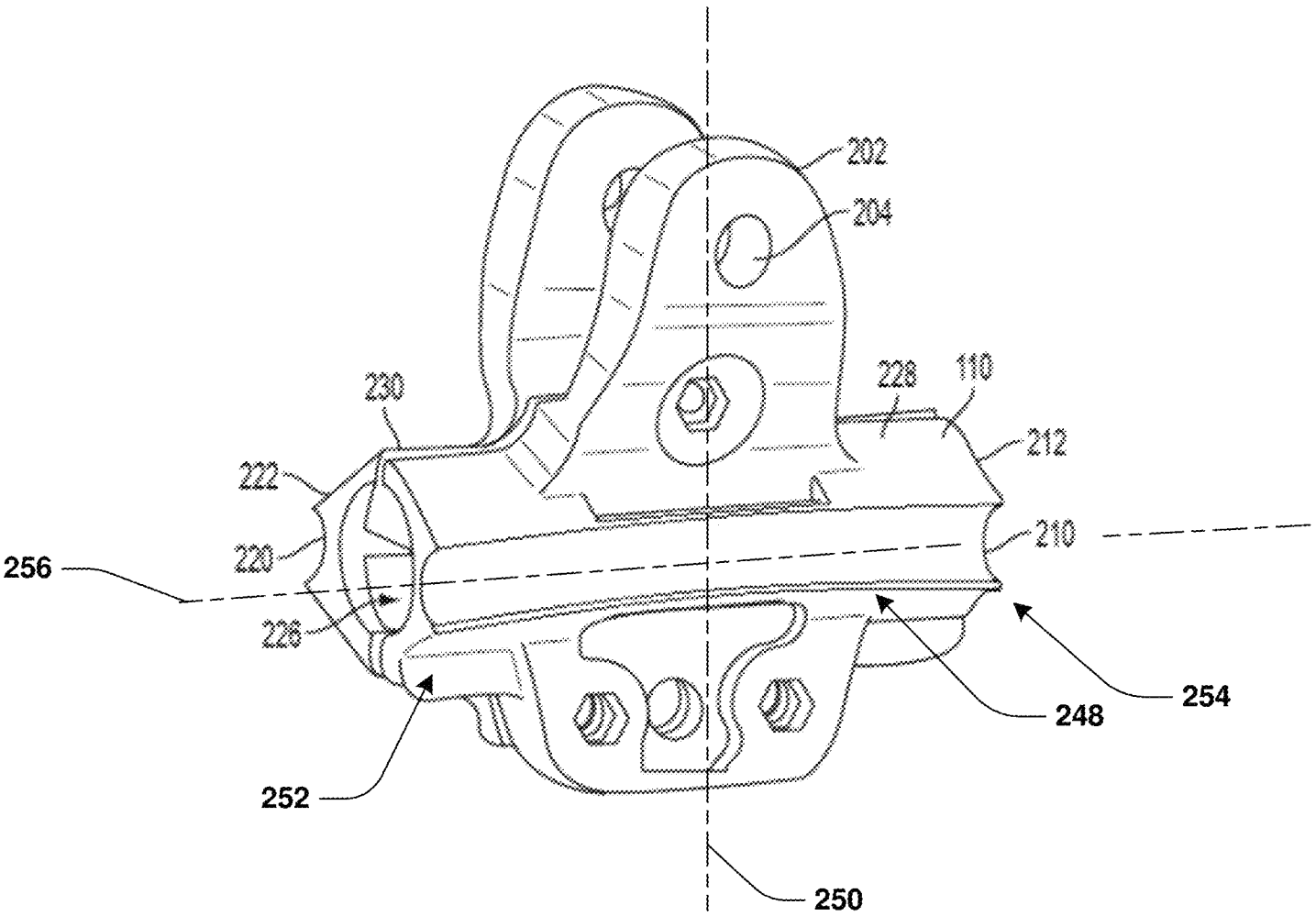
FIG. 2*c* illustrates an example support structure.

Turning to FIG. 2*c*, an example support structure 110 is illustrated in elevation view. Because the support structure 110 supports the shield wire 104 (shown in FIG. 2*a*) at a point along the shield wire 104, there is an inflection point in the shield wire 104 at this point (e.g., a peak in a sinusoidal curve caused by gravity acting upon the shield wire 104 in conjunction with supports located at various points along the shield wire 104). In order to more accurately cooperate with the arcuate configuration of the shield wire 104 at the support structure 110, the support structure 110 can define the first channel 210 and the second channel 220 as arcs 248. As shown in FIG. 2*c*, the arc 248 can have a relatively high point at a center line 250 of the support structure 110. The arc 248 can have relatively low points at each end 252, 254.

Figure 2D:
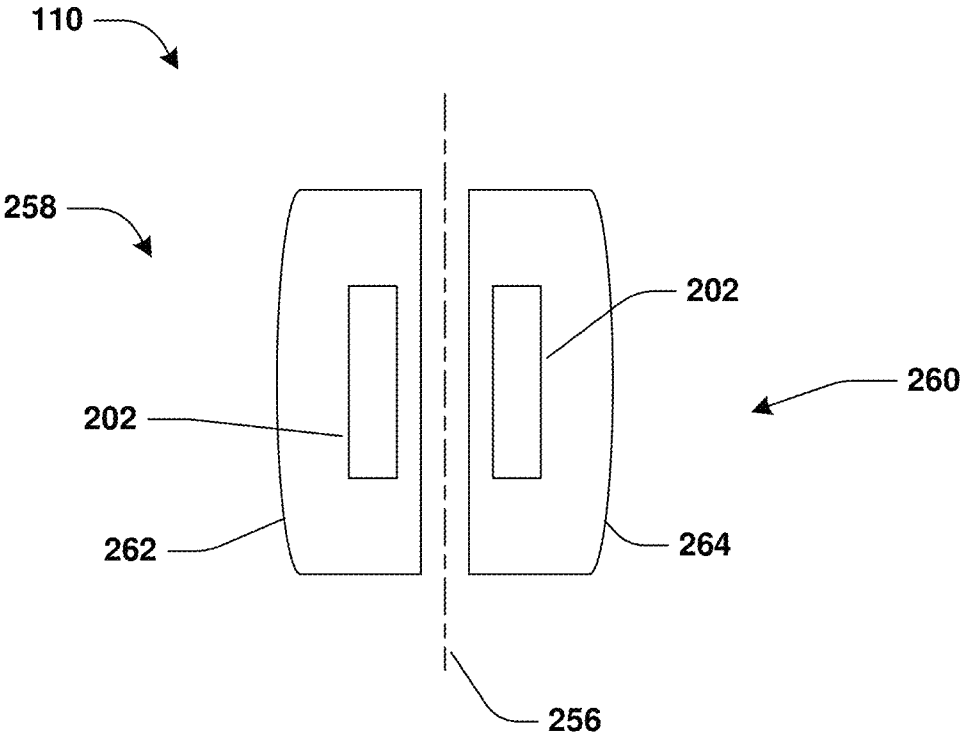
FIG. 2*d* illustrates an example support structure.

Turning to FIG. 2*d*, a top view of the support structure 110 is illustrated. The support structure can be centered about an axis 256 that can be parallel or colinear with a center line of the shield wire 104. In some examples, a first side 258 can include a profile 262 that is not a straight line, (e.g., an arc). A second side 260 can also include a profile 264 that is not a straight line (e.g., an arc). Of course, shapes other than an arc are also contemplated, and can include, but are not limited to, a number of connected straight line segments, parabolic curves, etc. The non-linear profiles of the first side 258 and the second side 260 can serve the same purpose as the curved first channel 210 and the curved second channel 220 of FIG. 2*c*. In other words, the first wire portion 244 and the second wire portion 246 of the guide wire 240 can include an inflection point at the support structure 110, however, this inflection point is not caused from the hanging of the shield wire 104 or the guide wire 240. Instead, this inflection point arises from the separation and rejoining of the first wire portion 244 and the second wire portion 246 with the shield wire 104. The described curvature of the first channel 210 and the second channel 220 help alleviate undue stress on the first wire portion 244 and the second wire portion 246. As such, the first channel 210 and the second channel 220 can have curvature in at least two different planes as shown in FIGS. 2*c* and 2*d*.

Figure 2E:
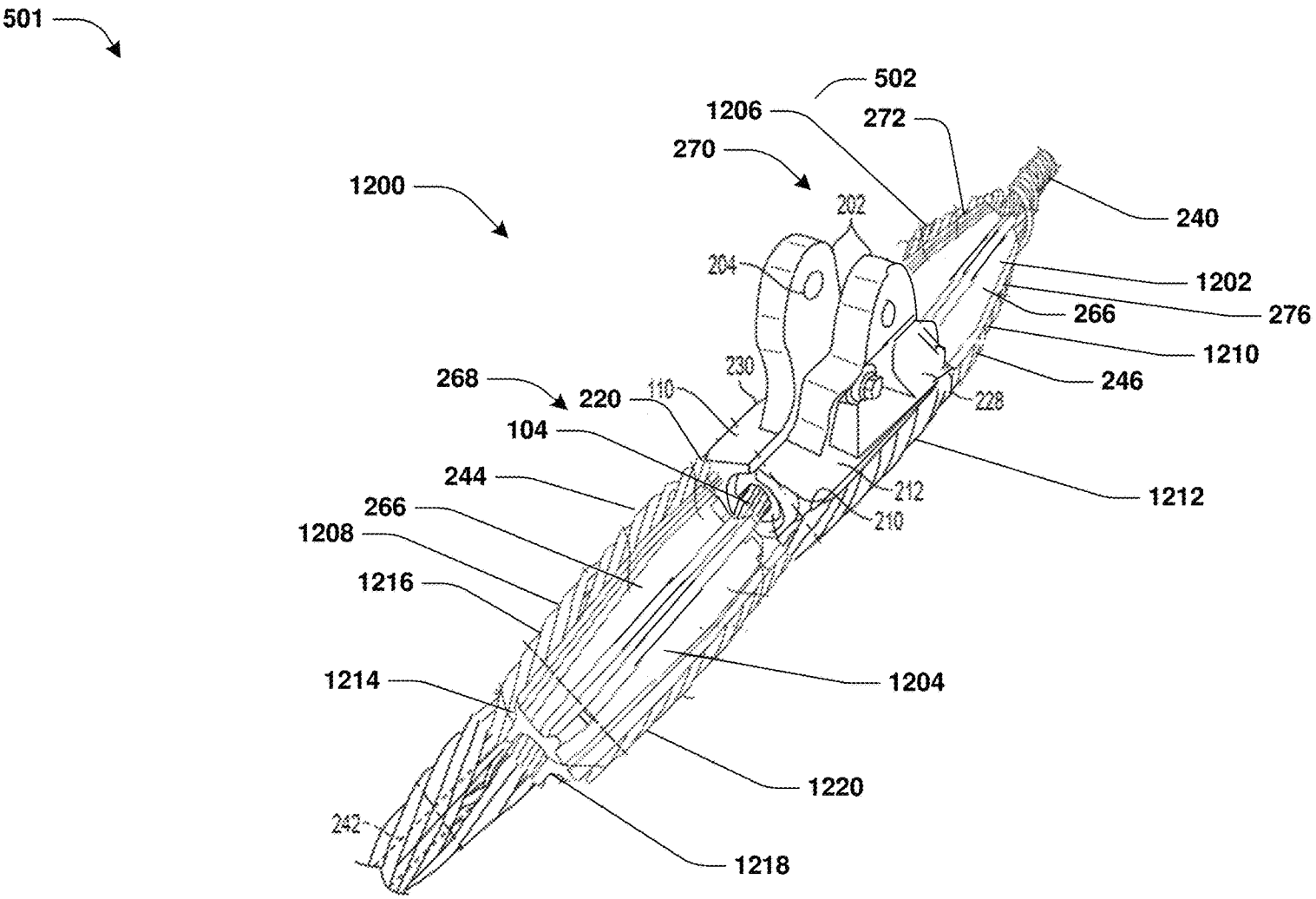
FIG. 2*e* illustrates an example support structure.

Turning to FIG. 2*e*, another example of the support structure 110 is illustrated. As in the example of FIG. 2*a*, the support structure 110 can be provided along the shield wire 104 such that the support structure 110 can support and/or receive the shield wire 104. In some examples, a wedge support structure 266 that can also be termed a wedge can be located on at least one of a first side 268 or a second side 270 of the support structure 110. As shown in FIG. 2*e*, the first side 268 can be a side of the support structure 110 on which the shield wire 104 passes into the third channel 226, and the second side 270 can be the opposing side of the support structure 110 on which the shield wire 104 passes out of the third channel 226. In some examples, the wedge support structure 266 located on the first side 268 of the support structure 110 is identical to the wedge support structure 266 on the second side 270 of the support structure 110.

Each of the wedge support structures 266 are configured to ease a transition of the first wire portion 244 and the second wire portion 246, between the two points of braided/helical attachment to the shield wire 104. In other words, the first wire portion 244 and the second wire portion 246 separate from each other on both the first side 268 and the second side 270 of the support structure 110. Additionally, the first wire portion 244 and the second wire portion 246 become increasingly distant from each other to pass through the first channel 210 and the second channel 220 on opposing sides of the support structure 110. The wedge support structures 266 help maximize the bending radius of the first wire portion 244 and the second wire portion 246 around the support structure 110. The wedge support structures 266 can also help provide smooth transitions at the inflection points of the first wire portion 244 and the second wire portion 246.

Figure 2F:
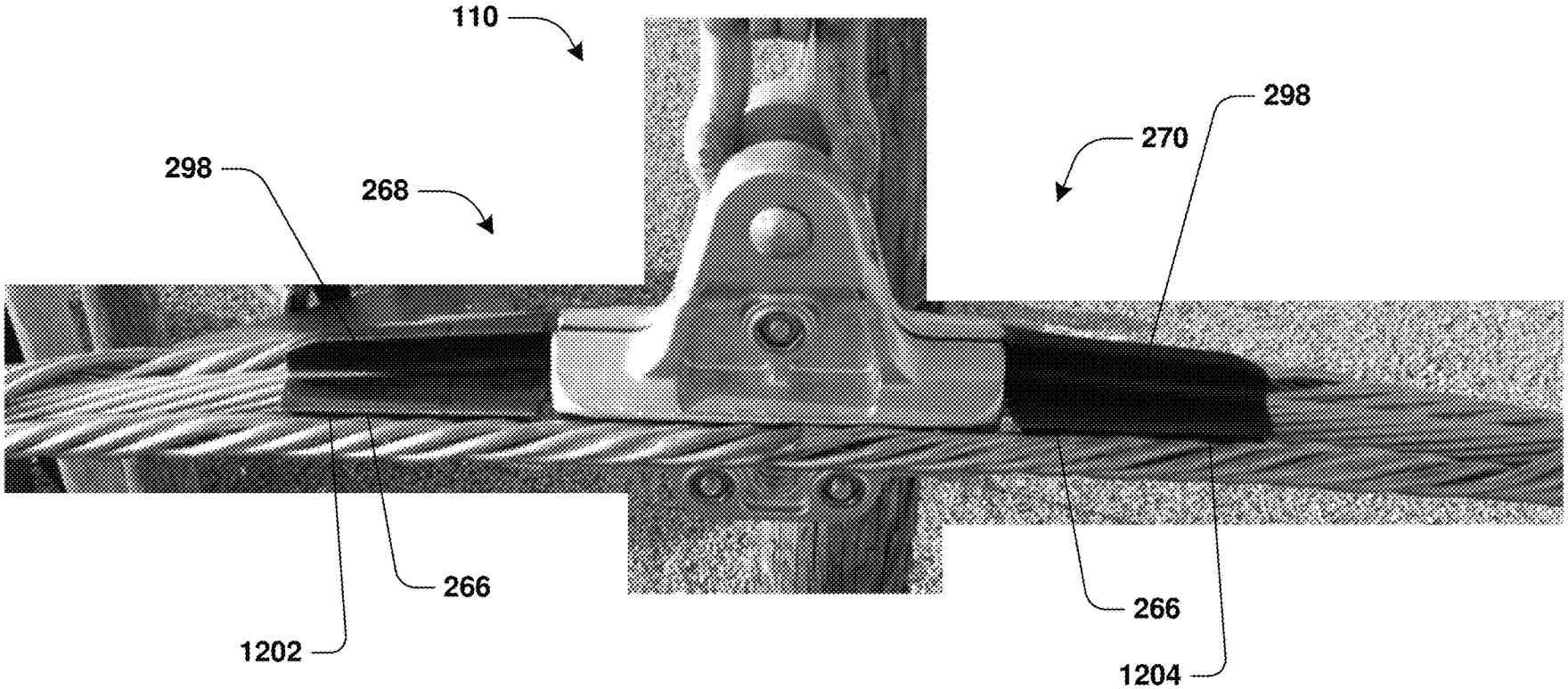
FIG. 2*f* illustrates an example support structure.

Turning to FIG. 2*f*, an example wedge support structure 266 is illustrated. The wedge support structure 266 can comprise any number of materials, including metals, plastics, composite materials, or the like. In some examples, the wedge support structure is composed of a urethane compound. Construction of urethane compounds can help prevent damage to the wedge support structure 266 during installation (e.g., snapping the wedge support structure 266 into place on the shield wire 104). The wedge support structure 266 can have at least some degree of rigidity/stiffness so as to support and/or receive the shield wire 104, the robot 102, etc.

The wedge support structure 266 can define a first channel 272 disposed on a first lateral side 274 of the wedge support structure 266 and a second channel 276 disposed on a second lateral side 278 of the wedge support structure 266. The first lateral side 274 can be defined by a first wall 280 and the second lateral side 278 can be defined by a second wall 282. In some examples, the first wall 280 is curved or angled with respect to an axis 284 of the wedge support structure 266. As shown in FIG. 2*f*, a width 286 of a distal end 288 of the wedge support structure 266 can be less than a width 290 of a proximal end 292 of the wedge support structure 266. In some examples, the first channel 272 extends parallel to the first wall 280 and the second channel 276 extends parallel to the second wall 282. As such, the first channel 272 and the second channel 276 are not necessarily parallel to each other.

The first channel 272 and the second channel 276 can extend substantially along the entire length of the wedge support structure 266, with the first channel 272 and the second channel 276 each defining a groove, furrow, opening, indentation, or the like into the wedge support structure 266. In some examples, the first channel 272 and the second channel 276 each have an outer side that is substantially open (e.g., not bordered) while an inner side is bordered by the wedge support structure 266.

The first wire portion 244 and the second wire portion 246 can be unwrapped/detached in a similar manner as described/illustrated with respect to FIG. 2*a*. The wedge support structure 266 defines a fifth channel 294 into which the shield wire 104 is received. The fifth channel 294 may be sized/shaped to receive the shield wire 104. For example, the fifth channel 294 may have a cross-sectional size that is slightly larger than a cross-sectional size of the shield wire 104 such that the shield wire 104 can be received and extend through the fifth channel 294. As previously described, the fifth channel 294 can be designed and constructed to provide a snap-fit with the shield wire 104. In some examples, the fifth channel 294 extends substantially parallel to the axis 284. The fifth channel 294 may be disposed/positioned between the first channel 272 and the second channel 276. In some examples, the fifth channel 294 may define a substantially continuous circumferential boundary around the shield wire 104, such that the shield wire 104 is generally limited from being inadvertently removed from the fifth channel 294. In other examples, the fifth channel 294 may include an opening 296 along a side (e.g., bottom side) of the fifth channel 294 such that the shield wire 104 can be inserted/removed from the fifth channel 294.

The wedge support structure 266 can include a fin 298 extending from a side (e.g., top side) of the wedge support structure 266. The fin 298 can cooperate with a portion of the robot 102. In some examples, the fin 298 can help limit rotation of the robot 102 about an axis, e.g., axis 284, which can be parallel or colinear with a central axis of the shield wire 104. In some examples, the fin 298 can extend away from the wedge support structure 266 in a vertical orientation to properly orient the robot 102 with respect to the shield wire 104.

Returning to FIG. 2*e*, a line bypass system 1200 is shown having a wedge support structure 266 on both the first side 268 and the second side 270 of the support structure 110. For clarity, one wedge support structure 266 can be termed a first wedge 1202, while a second wedge support structure 266 can be termed a second wedge 1204. The first wedge 1202 defines the first channel 272, into which the first section 1206 of a first wire portion 1208 of the guide wire 240 is received. Furthermore, the first wedge 1202 defines the second channel 276, into which a first section 1210 of a second wire portion 1212 of the guide wire 240 is received.

Similarly, the second wedge 1204 defines a third channel 1214, into which a second section 1216 of the first wire portion 1208 is received. The second wedge 1204 further defines a fourth channel 1218, into which a second section 1220 of the second wire portion 1212 is received. In some examples, and as shown in FIG. 2*f*, the fourth channel 1218 can extend non-parallel to the third channel 1214.

As shown in FIG. 2*e*, the second section 1216 of the first wire portion 1208 is contiguous with the first section 1206 of the first wire portion 1208. Similarly, the second section 1220 of the second wire portion 1212 is contiguous with the first section 1210 of the second wire portion 1212. Additionally, the first wedge 1202 defines the first channel 272 along a first side 274 of the first wedge 1202 and the first wedge 1202 defines the second channel 276 along an opposing second side 278 of the first wedge 1202 (e.g., the support structure). As can be seen in FIG. 2*e*, the second wedge 1204 similarly defines the third channel 1214 and the fourth channel 1218 on opposing sides of the second wedge 1204.

Turning to FIG. 2*f*, a side perspective view of a wedge support structure 266 is illustrated. Additionally, the wedge support structures 266 can be located on both the first side 268 and the second side 270 of the support structure 110. As previously described, the fins 298 of the first wedge 1202 and the second wedge 1204 can extend away from the first wedge 1202 and the second wedge 1204 in a generally vertical direction. FIG. 2*f* also illustrates the width 286 of the distal end 288 of the wedge support structure 266 can be less than a width 290 of a proximal end 292 of the wedge support structure 266. Each wedge support structure 266 can be oriented such that the proximal end 292 is oriented toward the support structure 110.

Figure 2G:
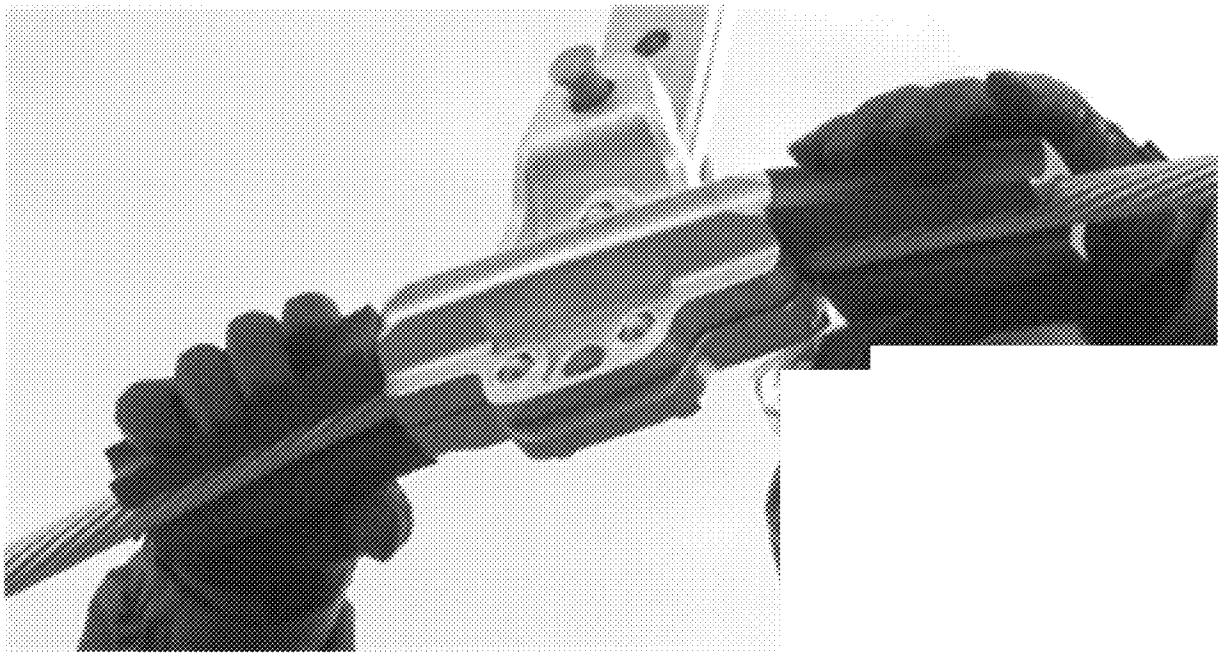
FIG. 2*g* illustrates an example support structure.

Turning to FIG. 2*g*, an example installation of wedge support members 266 on the first side and the second side of the support structure 110 is illustrated. As previously described, the wedge support members 266 can include a snap-fit feature to the shield wire 104.

Figure 2H:
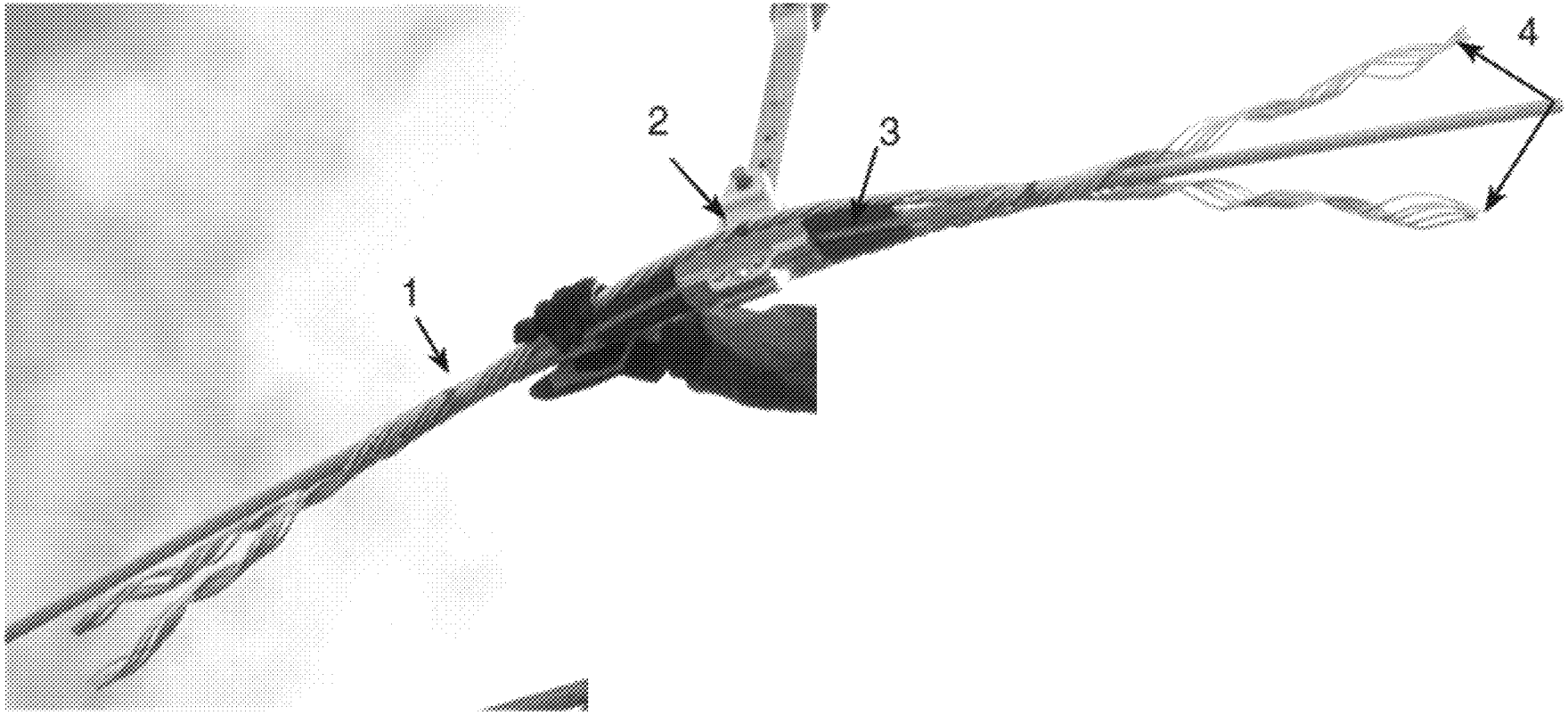
FIG. 2*h* illustrates an example support structure.

Turning to FIG. 2*h*, an example installation of the guide wire to the support structure 110 and the shield wire 104 is illustrated.

Figure 2I:
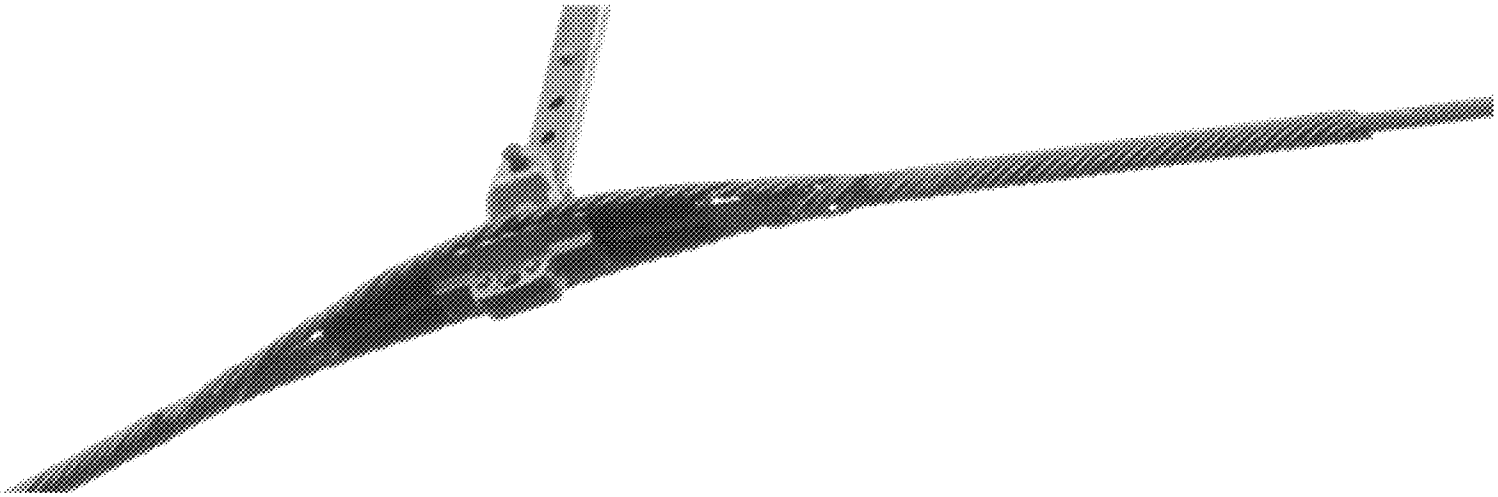
FIG. 2*i* illustrates an example support structure.

Turning to FIG. 2*i*, an example finished installation of the support structure 110 with wedge support structures 266 is illustrated.

Figure 2J:
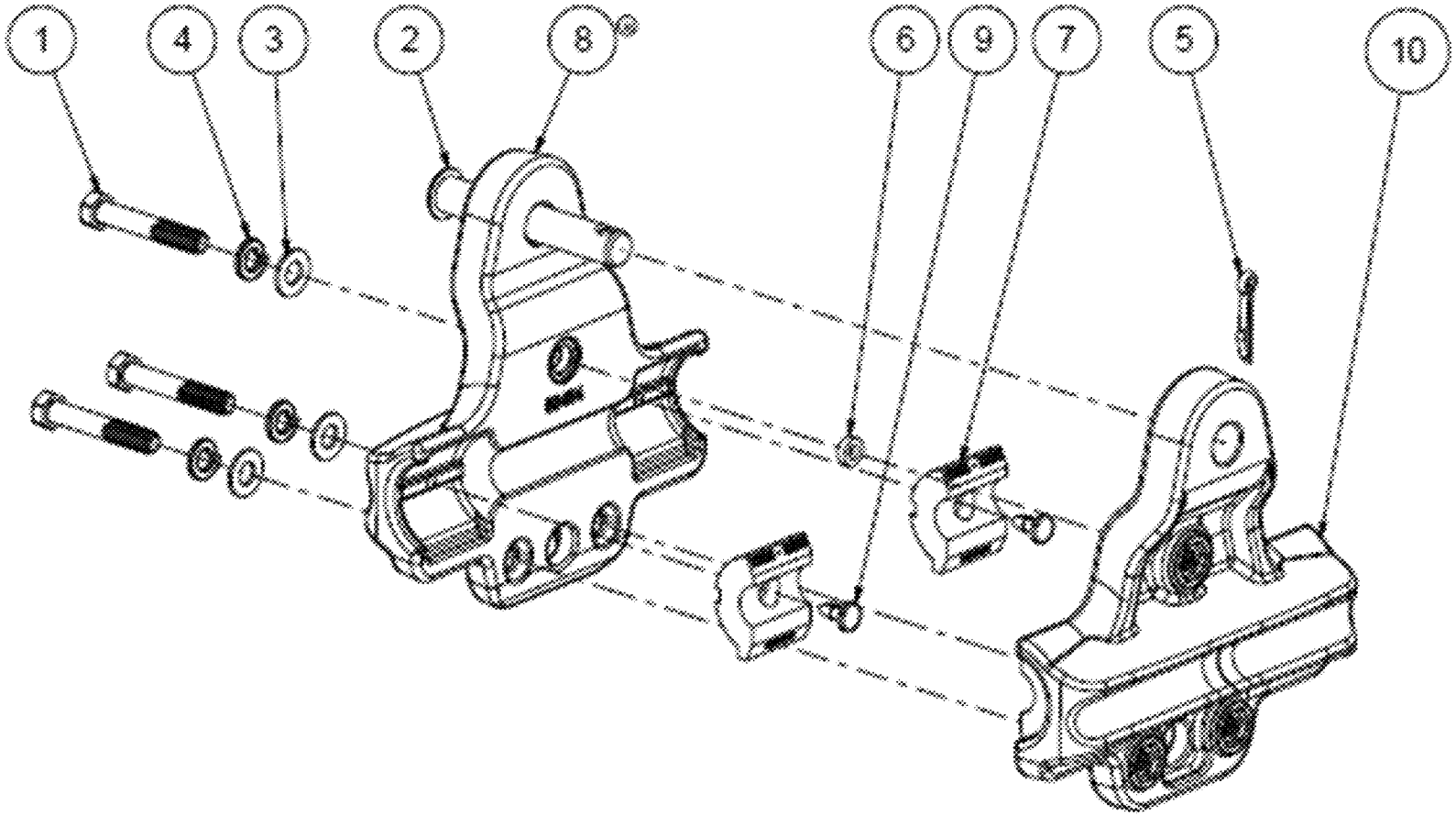
FIG. 2*j* illustrates an example support structure.

Turning to FIG. 2*j*, an exploded view of an example support structure 110 is illustrated.

Figure 3A:
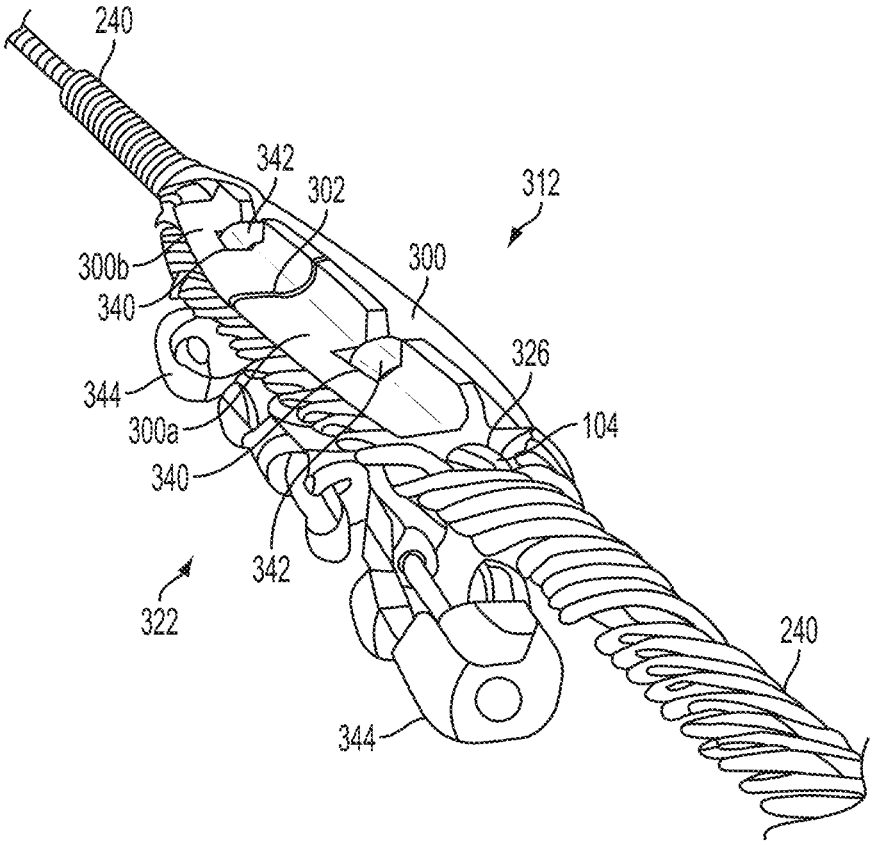
FIG. 3*a* illustrates a second example support structure.
Figure 3B:
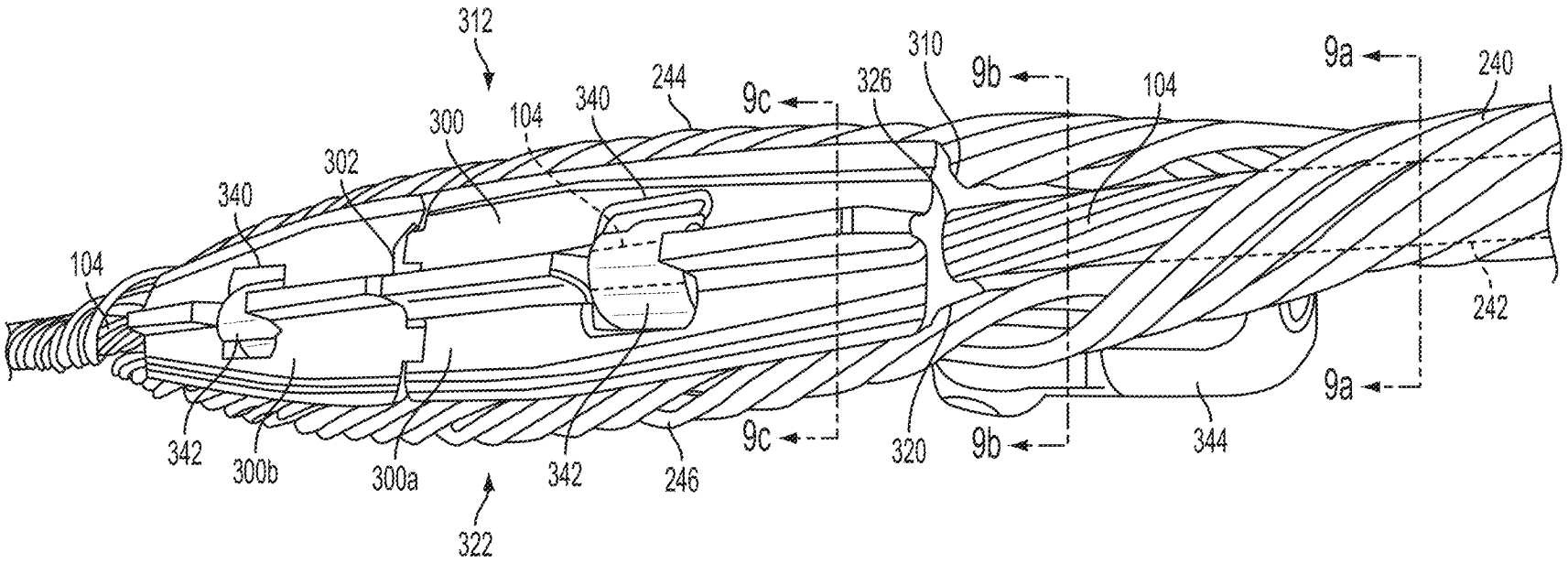
FIG. 3*b* illustrates a second example support structure.

Turning to FIGS. 3*a* and 3*b*, a second example support structure 300 is illustrated. The second support structure 300 can be positioned/used in a similar manner as the support structure 110 illustrated in FIG. 1. Indeed, the second support structure 300 can be positioned in association with the shield wire 104 and the guide wire 240. In this example, the shield wire 104 and the guide wire 240 are generally identical in size/structure as in the example of FIG. 2*a*. Indeed, the guide wire 240 may include the guide wire opening 242, the first wire portion 244, the second wire portion 246, etc.

The second support structure 300 can comprise any number of materials, including metals, plastics, composite materials, or the like. The second support structure 300 can have at least some degree of rigidity/stiffness so as to support and/or receive the shield wire 104, the robot 102, etc. In this example, the second support structure 300 comprises a pair of second support structures 300*a*, 300*b* positioned end to end with an interlocking portion 302 attaching the second support structures 300*a*, 300*b*. In other examples, any number of second support structures 300 may be provided. The second support structures 300*a*, 300*b* illustrated in FIG. 3*b* are generally identical, but for being mirror images of each other.

The second support structure 300 can define a first channel 310 disposed on a first lateral side 312 of the second support structure 300 and a second channel 320 disposed on a second lateral side 322 of the second support structure 300. In some examples, the second channel 320 extends parallel to the first channel 310. The first channel 310 and the second channel 320 can extend substantially along the entire length of the second support structure 300, with the first channel 310 and the second channel 320 each defining a groove, furrow, opening, indentation, or the like into the second support structure 300. In at least one example, the first channel 310 and the second channel 320 each have an outer side that is substantially open (e.g., not bordered) while an inner side is bordered by the second support structure 300.

The first wire portion 244 and the second wire portion 246 can be unwrapped/detached in a similar manner as described/illustrated with respect to FIG. 2*a*. For example, the first wire portion 244 and the second wire portion 246 can be spaced apart with the shield wire extending therebetween. The first wire portion 244 can be received within the first channel 310. The second wire portion 246 of the guide wire 240 can be received in the second channel 320. In this example, the second support structure 300 is sandwiched between the first wire portion 244 (in the first channel 310) and the second wire portion 246 (in the second channel 320), such that the first wire portion 244 and the second wire portion 246 are generally fixed with respect to the second support structure 300.

The second support structure 300 defines a third channel 326 into which the shield wire 104 is received. The third channel 326 may be sized/shaped to receive the shield wire 104. For example, the third channel 326 may have a cross-sectional size that is slightly larger than a cross-sectional size of the shield wire 104 such that the shield wire 104 can be received and extend through the third channel 326. In the illustrated example, the third channel 326 extends substantially parallel to the first channel 310 and the second channel 320. The third channel 326 may be disposed/positioned between the first channel 310 and the second channel 320. In some examples, the third channel 326 may define a substantially continuous circumferential boundary around the shield wire 104, such that the shield wire 104 is generally limited from being inadvertently removed from the third channel 326. In other examples, the third channel 326 may include an opening along a side (e.g., bottom side) of the third channel 326 such that the shield wire 104 can be inserted/removed from the third channel 326.

The second support structure 300 defines a damper opening 340 through which the shield wire 104 extends. The damper opening 340 comprises a gap, space cavity, or the like that extends through the second support structure 300 between a top surface and a bottom surface. In the illustrated example, the damper opening 340 is located between the first channel 310 and the second channel 320. In an example, the damper opening 340 is connected to the third channel 326 such that the shield wire 104 can extend within the damper opening 340.

A damper holder 342 can be provided to extend at least partially within the damper opening 340. In an example, the damper holder 342 can wrap around the shield wire 104, such that the shield wire 104 supports the damper holder 342. In the illustrated example, the damper holder 342 can extend downwardly from the damper opening 340, such that the damper holder 342 is suspended from/below the shield wire 104. In other examples, however, the damper holder 342 is not so limited, and may instead extend upwardly from the shield wire 104 so as to extend above the second support structure 300.

The damper holder 342 can be attached to and/or support one or more damper devices 344. The damper device 344 comprises any number of structures that can dampen/attenuate vibrations of the shield wire 104. For example, the damper device 344 may comprise one or more weights that can assist in dampening/attenuating vibrations. The damper device(s) 344 illustrated in FIGS. 3*a* and 3*b* comprise only one possible example, as any number of constructions, sizes, shapes, configurations, etc., of the damper device(s) 344 are contemplated.

Figure 4:
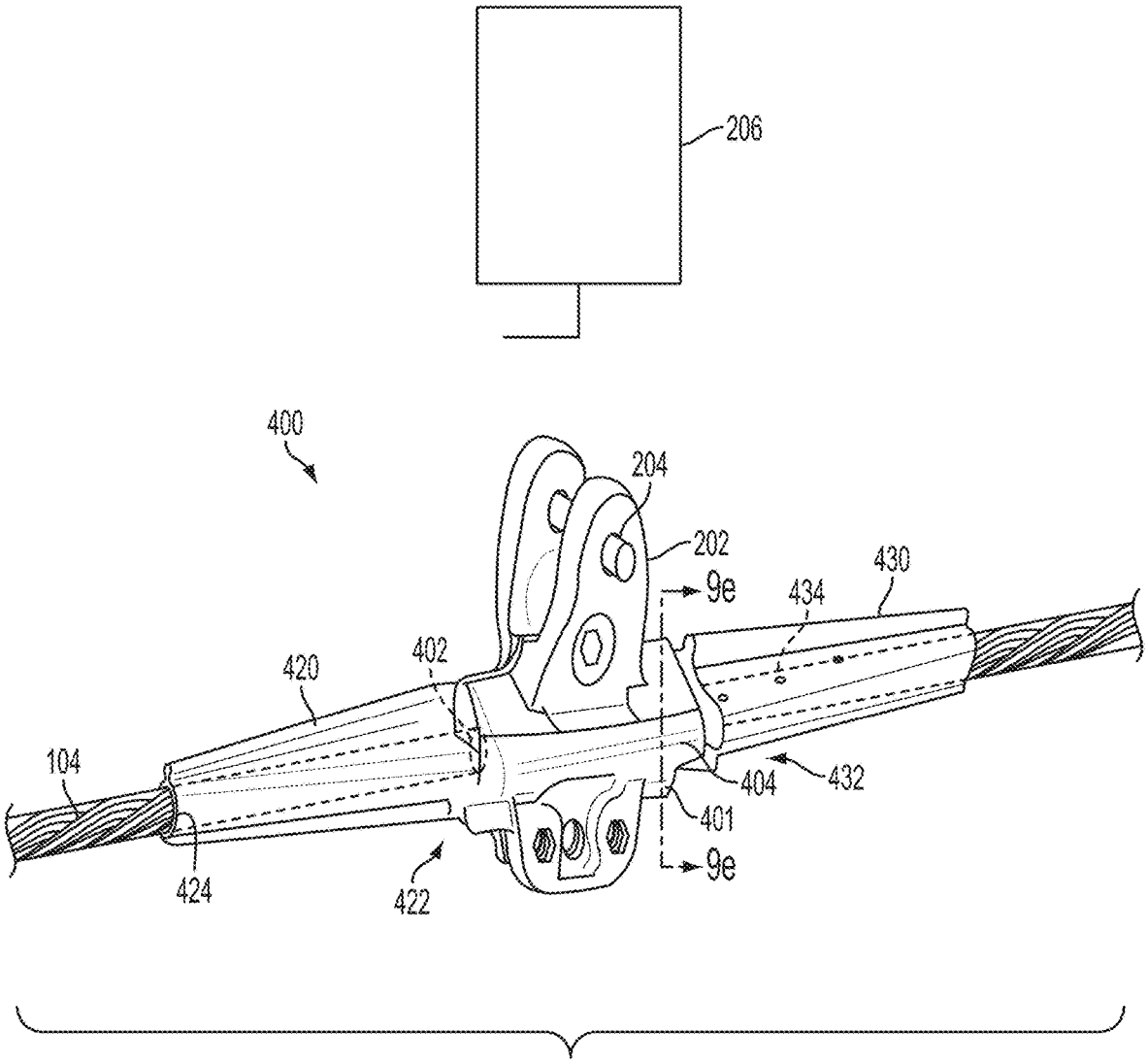
FIG. 4 illustrates a third example support structure.

Turning to FIG. 4, a third example support structure 400 is illustrated. The third support structure 400 can be positioned/used in a similar manner as the support structure 110 illustrated in FIG. 1. Indeed, the third support structure 400 can be positioned in association with the shield wire 104. In this example, the shield wire 104 is generally identical in size/structure as in the examples of FIGS. 2 and 3.

The third support structure 400 comprises a body 401. The body 401 can comprise any number of materials, including metals, plastics, composite materials, or the like. The body 401 can have at least some degree of rigidity/stiffness so as to support and/or receive the shield wire 104, the robot 102, etc. The body 401 may include the attachment structure 202. The attachment structure 202 may be generally identical to the attachment structure 202 described above with respect to FIG. 2, and may include the attachment opening 204. The attachment structure 202 can engage/attach to the suspension device 206 (portion of suspension device 206 extending through attachment opening 204 in FIG. 4) such that the suspension device 206 can hold/support the body 401. In other examples, the body 401 is not limited to the illustrated attachment structure 202, as any number of constructions/configurations are envisioned.

The body 401 can define a third channel 402 into which the shield wire 104 is received. The third channel 402 may be sized/shaped to receive the shield wire 104. For example, the third channel 402 may have a cross-sectional size that is slightly larger than a cross-sectional size of the shield wire 104 such that the shield wire 104 can be received and extend through the third channel 402. In some examples, the third channel 402 may define a substantially continuous circumferential boundary around the shield wire 104, such that the shield wire 104 is generally limited from being inadvertently removed from the third channel 402.

Figure 9A:
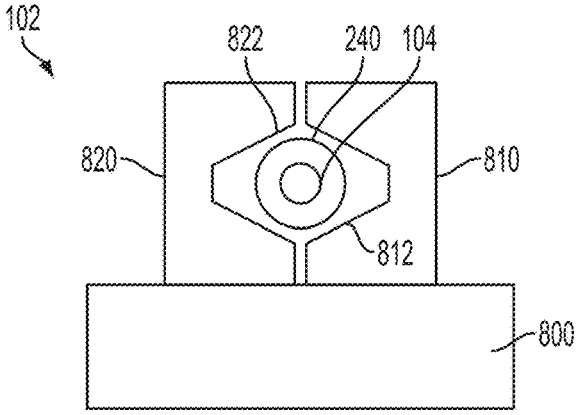
FIG. 9*a* illustrates an example robot.
Figure 9B:
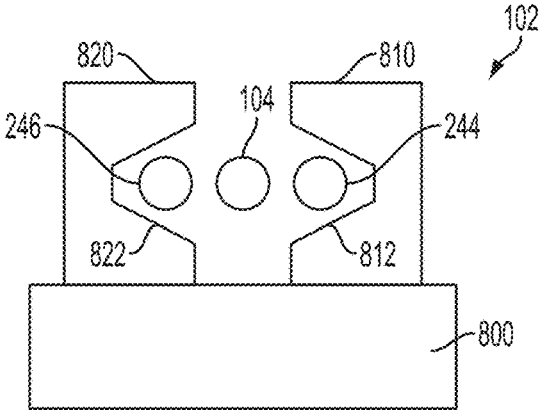
FIG. 9*b* illustrates an example robot.
Figure 9C:
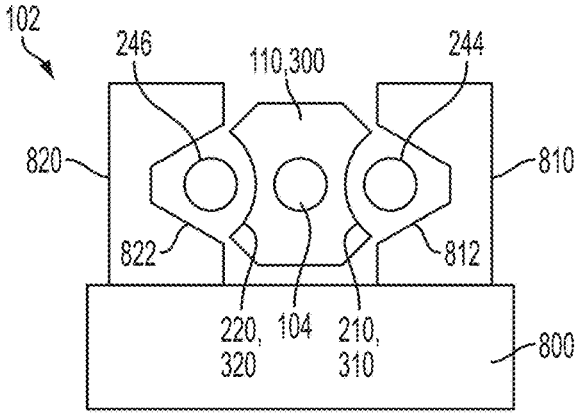
FIG. 9*c* illustrates an example robot.
Figure 9D:
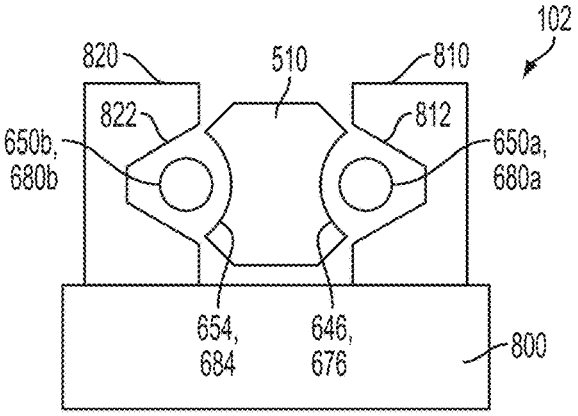
FIG. 9*d* illustrates an example robot.
Figure 9E:
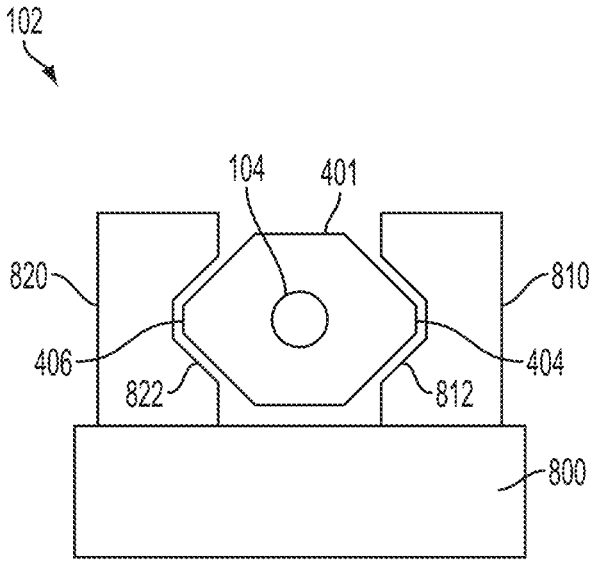
FIG. 9*e* illustrates an example robot.

The body 401 comprises a first support edge 404 and a second support edge 406 (illustrated in FIG. 9*e* since the second support edge 406 is obscured from view in FIG. 4). The second support edge 406 extends parallel to the first support edge 404 on opposing sides of the body 401, with the first support edge 404 and the second support edge 406 being generally identical in size, shape, construction, etc. In an example, the first support edge 404 and the second support edge 406 project radially outwardly from a center of the body 401 to define a point, ledge, outcropping, or the like. As will be described in more detail below, the robot 102 can engage/grip the first support edge 404 and the second support edge 406 as the robot 102 traverses the body 401.

The third support structure 400 can include a first support portion 420. The first support portion 420 is positioned on a first side 422 of the body 401. The first support portion 420 extends coaxially with respect to the third channel 402 of the body 401. The first support portion 420 comprises any number of materials, including metal materials (e.g., conductors), non-metal materials (plastics, composite materials, etc.), or the like.

The first support portion 420 defines a first channel 424 into which the shield wire 104 is received. The first channel 424 extends coaxially with respect to the third channel 402 of the body 401. In this example, the first channel 424 extends entirely through the first support portion 420 from one end to an opposing end, such that the shield wire 104 can extend completely through the first channel 424. While the first channel 424 comprises any number of sizes/shapes, in some examples, the first channel 424 generally matches a size/shape of the shield wire 104.

The third support structure 400 can include a second support portion 430. The second support portion 430 is positioned on a second side 432 of the body 401. The second support portion 430 extends coaxially with respect to the third channel 402 of the body 401 and with the first support portion 420. The second support portion 430 comprises any number of materials, including metal materials (e.g., conductors), non-metal materials (plastics, composite materials, etc.), or the like.

The second support portion 430 defines a second channel 434 (illustrated with dashed lines since the second channel 434 is obscured from view in FIG. 4) into which the shield wire 104 is received. The second channel 434 extends coaxially with respect to the third channel 402 of the body 401. In this example, the second channel 434 extends entirely through the second support portion 430 from one end to an opposing end, such that the shield wire 104 can extend completely through the second channel 434. While the second channel 434 comprises any number of sizes/shapes, in some examples, the second channel 434 generally matches a size/shape of the shield wire 104.

Figure 5:
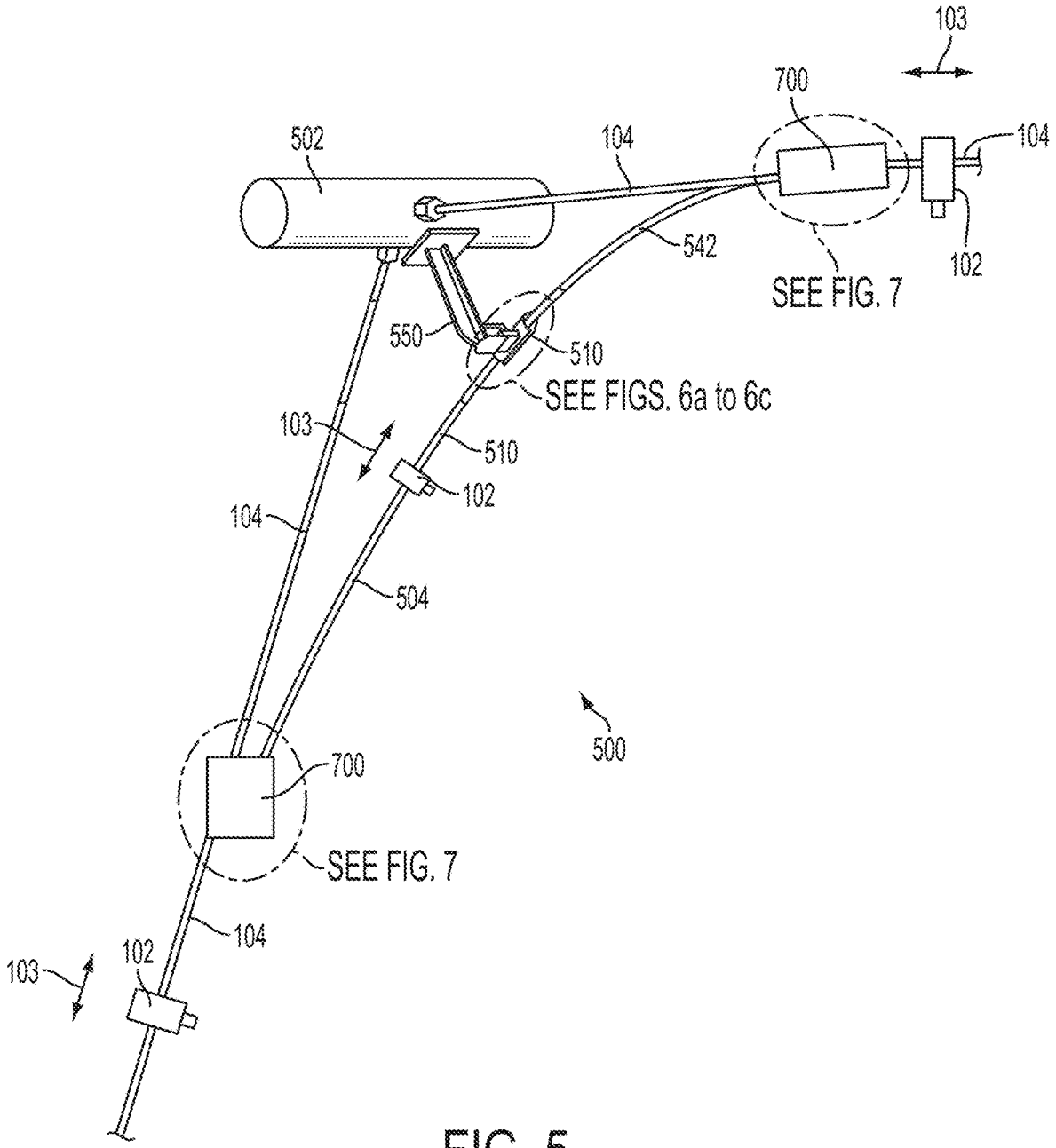
FIG. 5 illustrates a second example line bypass system.

Turning to FIG. 5, a second example line bypass system 500 is illustrated. The second line bypass system 500 is illustrated generically/schematically, as the second line bypass system 500 includes any number of structures, configurations, constructions, etc., some of which are described/illustrated with respect to FIGS. 6 to 9. In general, the robot 102 may traverse 103 (e.g., illustrated generically with movement lines) along an overhead transmission line (e.g., shield wire 104) to collect information regarding the lines, structures, obstructions, etc.

In this example, a pair of shield wires 104 may be provided, with the shield wires 104 attached to a utility structure 502. To allow for the robot 102 to traverse the shield wires 104 (e.g., to move from one shield wire 104 to another shield wire 104), a bridge 504 may be provided. The bridge 504 can extend between the shield wires 104, and allows for the robot 102 to traverse the bridge 504 while bypassing the utility structure 502. As such, the robot 102 can move from one shield wire 104, across the bridge 504, and to the other shield wire 104. The bridge 504 is illustrated generically/schematically as the bridge 504 includes any number of sizes (e.g., lengths), constructions, etc. Moreover, the bridge 504 is not limited to being provided for the robot 102 to bypass the utility structure 502. Indeed, any number of structures, or line devices attached directly to the line, some of which may not include the utility structure 502, may exist, thus necessitating the use of the bridge 504. The bridge 504 can be a flexible or rigid member.

The second line bypass system 500 can include a fourth support structure 510. The fourth support structure 510 is illustrated generically/schematically in FIG. 5, as the fourth support structure 510 includes any number of constructions. Indeed, the fourth support structure 510 is illustrated in more detail in FIGS. 6*a* to 6*c*. In general, the fourth support structure 510 can be provided within and/or as part of the bridge 504. The fourth support structure 510 can hold/support a guide wire (e.g., guide wire 540 and second guide wire 542). The guide wire 540 and the second guide wire 542 are similar in structure to the guide wire 242 illustrated in FIGS. 2*a* and 2*b*. The fourth support structure 510 can also be held/supported, such as by a suspension device 550. It will be appreciated that the suspension device 550 may or may not be included as part of the system (e.g., line bypass system). Indeed, in some examples, the suspension device 550 may include an arm, fitting, or the like to suspend the support structure 510. As such, in this example, the fourth support structure 510 can assist in holding/supporting the guide wire 540 and the second guide wire 542 at an elevated position.

Figure 6A:
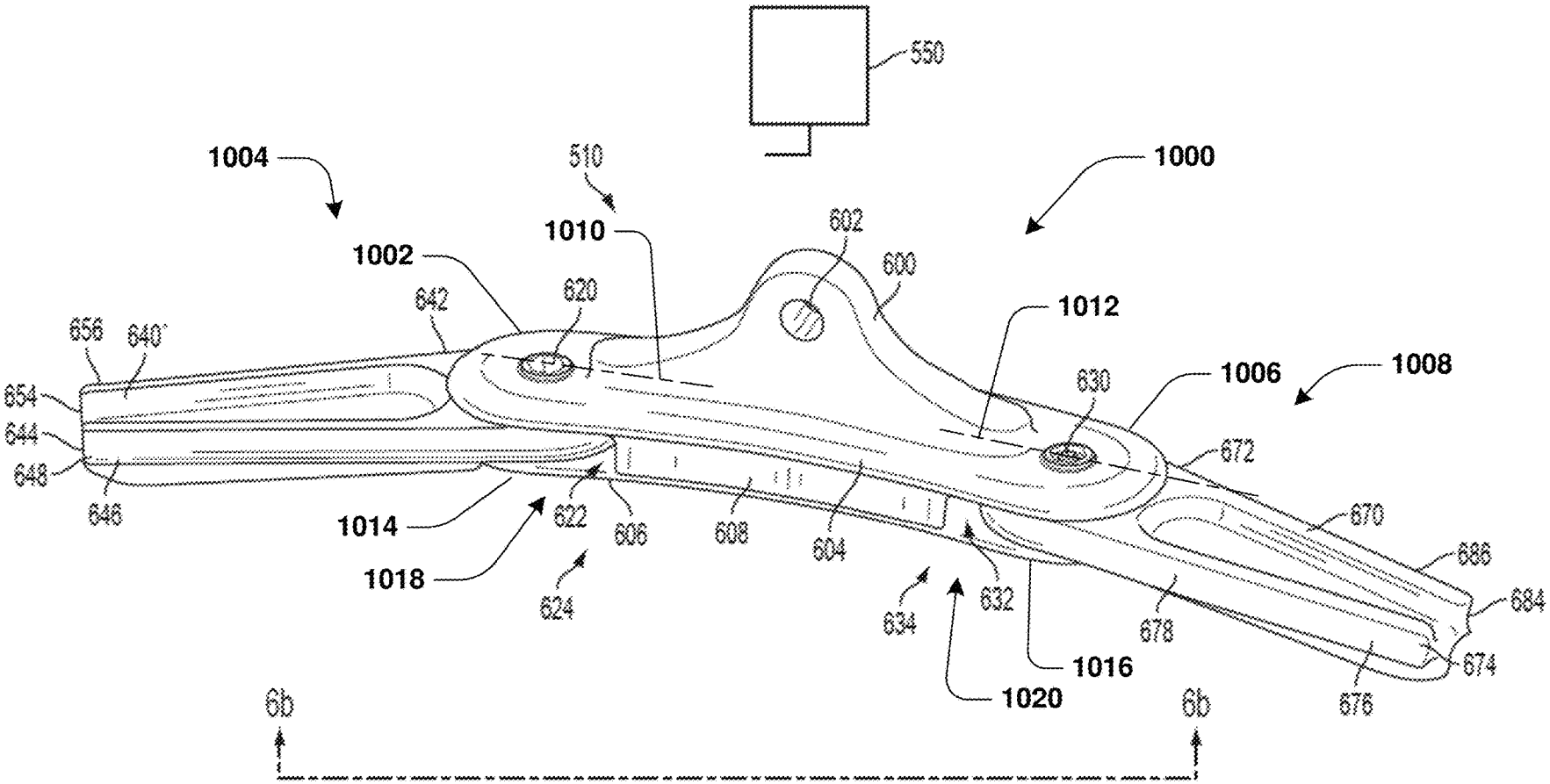
FIG. 6*a* illustrates a fourth example support structure for a bridge component.
Figure 6B:
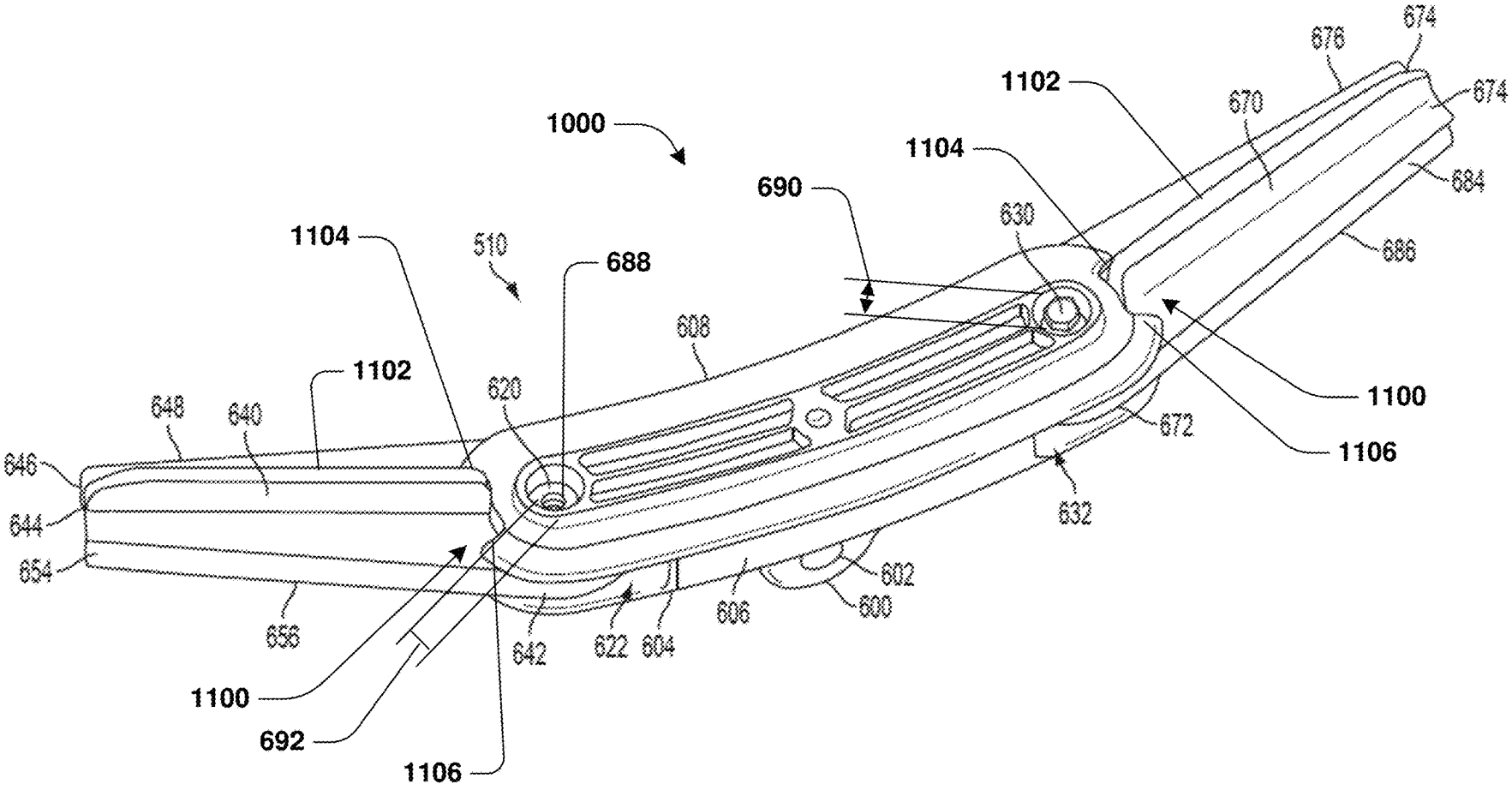
FIG. 6*b* illustrates a fourth example support structure for a bridge component.
Figure 6C:
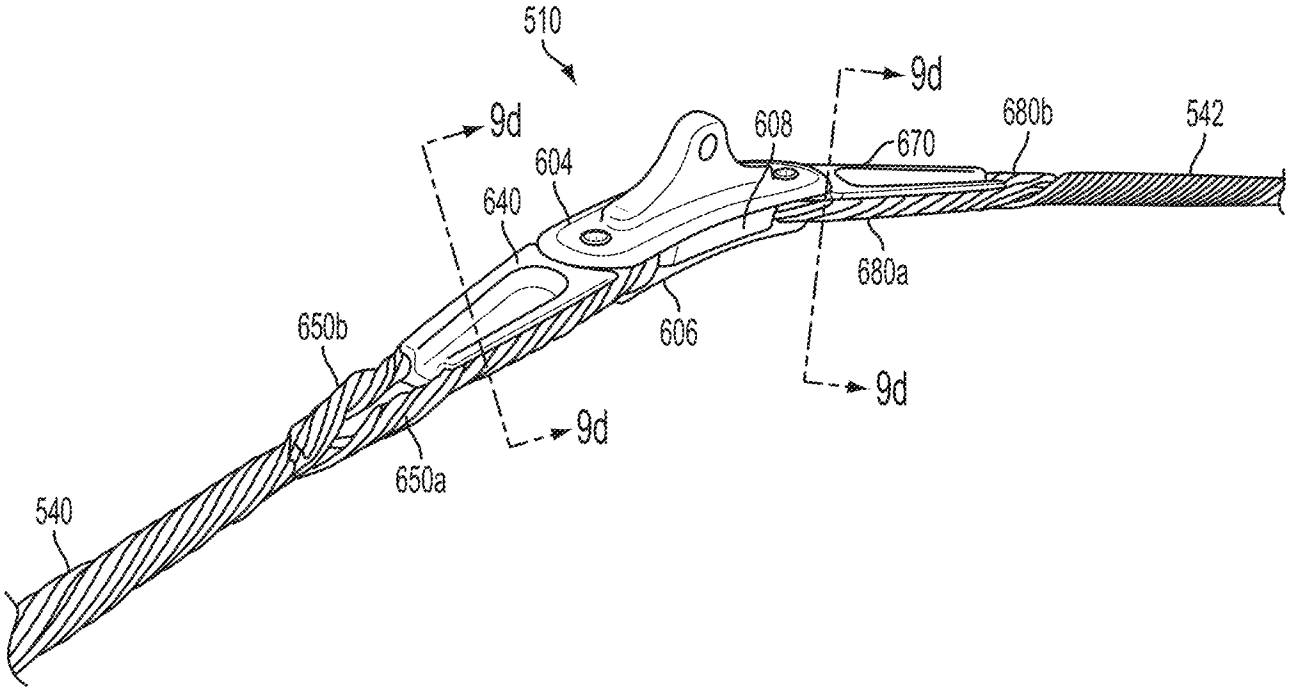
FIG. 6*c* illustrates a fourth example support structure for a bridge component.

Turning to FIGS. 6*a* to 6*c*, an example of the fourth support structure 510 is illustrated. FIG. 6*b* illustrates a bottom-up view along lines 6*b*-6*b* of FIG. 6*a*. The fourth support structure 510 comprises any number of materials, including metals, plastics, composite materials, or the like. In this example, the fourth support structure 510 has at least some degree of rigidity/stiffness so as to support the guide wire 540, the second guide wire 542, the robot 102, etc.

The fourth support structure 510 comprises an attachment structure 600. The attachment structure 600 may be located at an upper side of the fourth support structure 510. The attachment structure 600 may include an attachment opening 602 through which an attachment device can be inserted. In an example, the attachment structure 600 can attach to the suspension device 550 (e.g., illustrated in FIG. 5) such that the fourth support structure 510 is supported below the suspension device 550. In one possible example, a portion of the suspension device 550 may be inserted through the attachment opening 602 such that the suspension device 550 can hold/attach/support the attachment structure 600.

The fourth support structure 510 can include a first support portion 604 and a second support portion 606 that is spaced apart from the first support portion 604. In an example, an attachment portion 608 can attach the first support portion 604 to the second support portion 606. The first support portion 604 comprises a substantially flat/planar body on which the attachment structure 600 is supported. The first support portion 604 is elongated and includes opposing rounded ends. In other examples, the first support portion 604 is not limited to the illustrated size/shape, and, instead, may include quadrilateral shapes, ovoid shapes, or the like.

The second support portion 606 can have a generally similar or identical size/shape as the first support portion 604. For example, the second support portion 606 comprises a substantially flat/planar body. The second support portion 606 is elongated and includes opposing rounded ends.

The attachment portion 608 can extend between the first support portion 604 and the second support portion 606. In this example, the attachment portion 608 is positioned on an opposite side of the first support portion 604 from the attachment structure 600. The attachment portion 608 can maintain the first support portion 604 spaced apart from the second support portion 606 such that the first support portion 604 and the second support portion 606 are generally immovable/fixed with respect to each other.

The fourth support structure 510 comprises a first connecting structure 620. The first connecting structure 620 can extend between the first support portion 604 and the second support portion 606. The first connecting structure 620 comprises any number of fasteners, including screws, bolts, nails, pins, or the like. In an example, the first connecting structure 620 is spaced apart from the attachment portion 608 to define a first opening 622. The first opening 622 can extend between the first support portion 604 on an upper side and the second support portion 606 on a lower side. The first opening 622 may also be bounded by the attachment portion 608 on one side and the first connecting structure 620 on an opposing side. In the illustrated example, the first opening 622 is defined on a first side 624 of the attachment portion 608.

The fourth support structure 510 comprises a second connecting structure 630. The second connecting structure 630 can extend between the first support portion 604 and the second support portion 606. The second connecting structure 630 comprises any number of fasteners, including screws, bolts, nails, pins, or the like. In an example, the second connecting structure 630 is spaced apart from the attachment portion 608 to define a second opening 632. The second opening 632 can extend between the first support portion 604 on an upper side and the second support portion 606 on a lower side. The second opening 632 may also be bounded by the attachment portion 608 on one side and the second connecting structure 630 on an opposing side. In the illustrated example, the second opening 632 is defined on a second side 634 of the attachment portion 608.

The fourth support structure 510 can include a first guide device 640. In an example, the first guide device 640 extends between a first end 642 and a second end 644. The first end 642 of the first guide device 640 can be attached to the first connecting structure 620. The first guide device 640 can be attached in any number of ways to the first connecting structure 620. In one possible example, the first connecting structure 620 can extend through the first guide device 640 (e.g., such as through an opening, or the like), such that the first guide device 640 is movably attached with respect to the first connecting structure 620.

In the illustrated example, the first guide device 640 defines a first channel 646 disposed on a first lateral side 648 of the first guide device 640. In some examples, the first channel 646 receives a first wire portion 650*a* of the guide wire 540 (illustrated in FIG. 6*c*). The first guide device 640 defines a second channel 654. In some examples, the second channel 654 may extend parallel to the first channel 646 while in other examples, the second channel 654 and the first channel 646 may taper into each other to create the transition from the attachment portion 608 to re-engage with the second shield wire 542. In the illustrated example, the second channel 654 is disposed on a second lateral side 656 of the first guide device 640. In some examples, the second channel 654 receives a second wire portion 650*b* of the guide wire 540. In the illustrated example of FIG. 6*c*, the first opening 622 can movably receive the guide wire 540.

The fourth support structure 510 can include a second guide device 670. The second guide device 670 may be generally identical to the first guide device 640. In an example, the second guide device 670 extends between a first end 672 and a second end 674. The first end 672 of the second guide device 670 can be attached to the second connecting structure 630. The second guide device 670 can be attached in any number of ways to the second connecting structure 630. In one possible example, the second connecting structure 630 can extend through the second guide device 670 (e.g., such as through an opening, or the like), such that the second guide device 670 is movably attached with respect to the second connecting structure 630. The first guide device 640 and the second guide device 670 can support the guide wire (e.g., guide wire loop, for example) to avoid fatigue issues under dynamic tension.

Returning to FIG. 6*a*, in some examples, the first support portion 604, the second support portion 606, and the attachment portion 608 can be a unitary structure, e.g., a part that is cast as a single piece. In some examples, the fourth support structure 510 can include a mid-section 1000. The mid-section 1000 can include a first flange 1002 to a first side 1004 of the mid-section 1000. The fourth support structure 510 can also include a second flange 1006 to a second side 1008 of the mid-section 1000. As shown, the second side 1008 can be opposite the first side 1004 relative to the mid-section 1000.

The fourth support structure 510 can include a first projection 620 projecting from the first flange 1002. The first projection 620 can extend downward from the first flange 1002 (e.g., toward the bottom of the figure). A first opening 622 is defined between the mid-section 1000 and the first projection 620. The first opening 622 is configured to movably receive the first guide wire 540. A second projection 630 projects from the second flange 1006, and a second opening 632 is defined between the mid-section 1000 and the second projection 630. The second opening 632 is configured to movably receive a second guide wire 542.

In some examples, the first flange 1002 extends along a first flange axis 1010 and the second flange 1006 extends along a second flange axis 1012. In some examples, the first flange axis 1010 is not parallel to or colinear with the second flange axis 1012, in other words, the fourth support structure 510 is not necessarily fashioned along a straight line from end to end.

In some examples, the fourth support structure 510 can include a third flange 1014 to the first side 1004 of the mid-section 1000 and a fourth flange 1016 to the second side 1008 of the mid-section 1000. As such, the first flange 1002 and the third flange 1014 define a third opening 1018 to receive the first guide device 640 for the first guide wire 540. Similarly, the second flange 1006 and the fourth flange 1016 define a fourth opening 1020 to receive the second guide device 670 for the second guide wire 542.

In such examples, the first guide device 640 and the second guide device 670 can be assembled to the fourth support structure 510 by sliding the first guide device 640 into the third opening 1018 and the second guide device 670 into the fourth opening 1020. The first guide device 640 and the second guide device 670 are then attached to the first projection 620 and the second projection 630 by any suitable structure or method.

In the illustrated example, the second guide device 670 defines a first channel 676 disposed on a first lateral side 678 of the second guide device 670. In some examples, the first channel 676 receives a first wire portion 680*a* of the second guide wire 542. The second guide device 670 defines a second channel 684 extending parallel to the first channel 676. In the illustrated example, the second channel 684 is disposed on a second lateral side 686 of the second guide device 670. In some examples, the second channel 684 receives a second wire portion 680*b* of the second guide wire 542. In the illustrated example of FIG. 6*c*, the second opening 632 can movably receive the second guide wire 542.

In operation, the first opening 622 can movably receive at least a portion of the guide wire 540, such as ends of the first wire portion 650*a* and the second wire portion 650*b*. As such, the guide wire 540, by being supported by the guide device 640, is movable due to the movable attachment between the guide device 640 and the first connecting structure 620. Likewise, the second opening 634 can movably receive at least a portion of the second guide wire 542, such as ends of the first wire portion 680*a* and the second wire portion 680*b*. As such, the second guide wire 542, by being supported by the second guide device 670, is movable due to the movable attachment between the second guide device 670 and the second connecting structure 630.

Returning to FIG. 6*b*, at least one of the first support portion 604 or the second support portion 606 can physically limit the rotation of at least one of the first guide device 640 or the second guide device 670. In some examples, the second support portion 606 can define a slot 1100 at least partially defined by a first wall 1104 and a second wall 1106. The slot 1100 is configured to cooperate with a structure 1102 located on the guide devices 640, 670. Any suitable physical embodiment can be used for the structure 1102 including, but not limited to, tabs, fins, buttons, etc. It can be seen in FIG. 6*b*, that as the guide device 640, 670 rotates, the structure 1102 moves with respect to the slot 1100. At a particular position, the structure 1102 will contact a first wall 1104 or a second wall 1106 providing a physical interference between the support portion 604, 606 and the guide device 640, 670. In this way, the rotation of the guide device 640, 670 can be limited as it rotates about the connecting structures 620, 630.

Of course, in some examples, the slot 1100 and the structure 1102 can switch locations without affecting the limitation of rotation. For example, the slot 1100 can be defined by the guide device 640, 670 while the structure can be attached to the first or second support portion 606, 606.

Figure 6D:
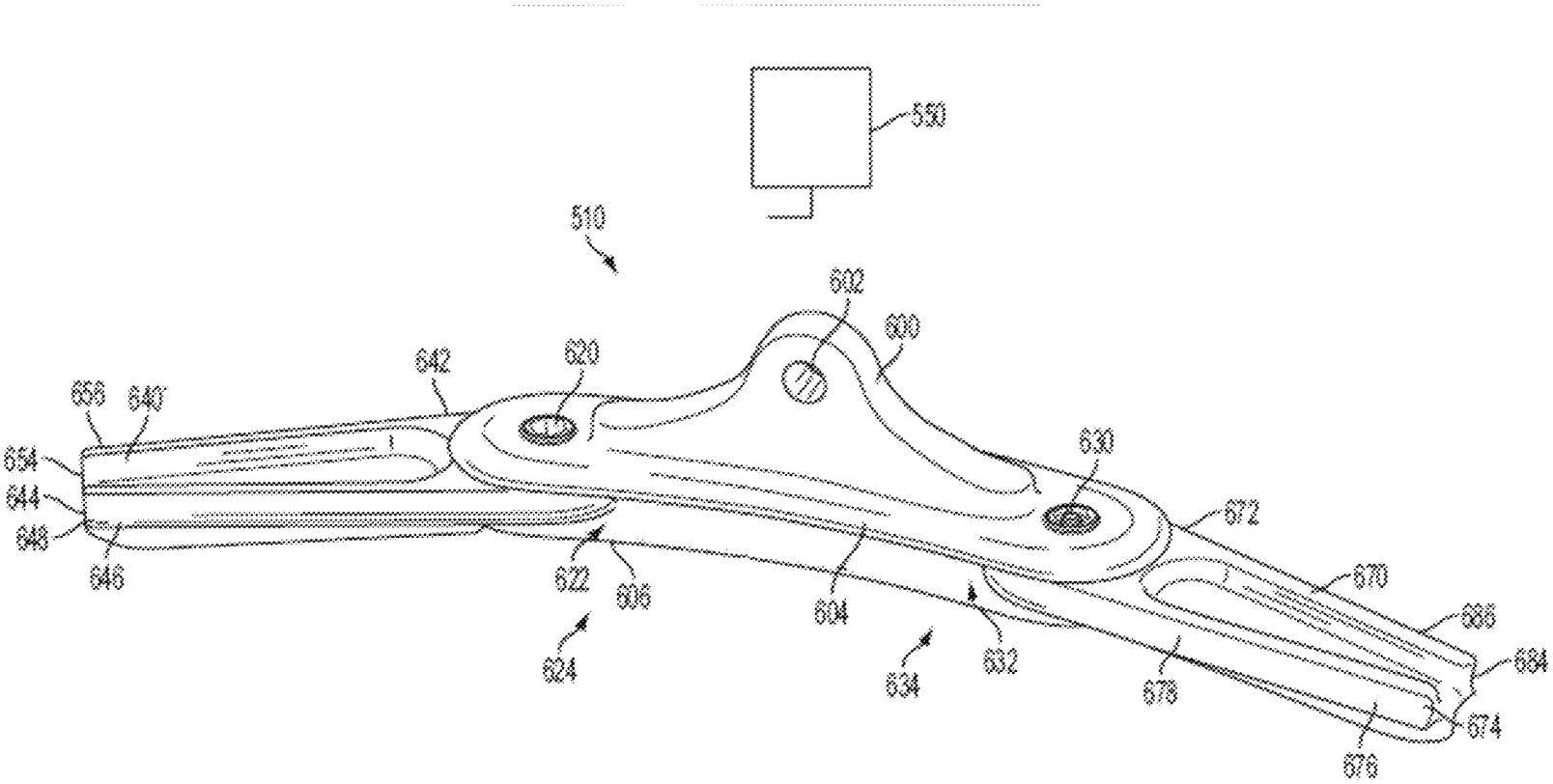
FIG. 6*d* illustrates a fourth example support structure for a bridge component.

Turning to FIG. 6*d*, another example of the fourth support structure 510 is illustrated. In this example, the first support portion 604 defines a first opening 622. The first guide device 640 defines a second opening 688 (shown in FIG. 6*b*). The first connecting structure 620 is configured to pass through the first opening 622 and the second opening 688 to connect the first guide device 640 to the first support portion 604. As with previously discussed examples of the fourth support structure 510, the first guide device 640 defines a first channel 646 into which the first wire portion 650*a* of the first guide wire 540 (shown in FIG. 6*c*) is received. Additionally, the first channel 646 extends a distance in a direction substantially parallel to a direction along which the first guide wire 540 extends.

Returning to FIG. 6*b*, the first connecting structure 620 has a first dimension 690 and the second opening 688 has a second dimension 692. As shown, the first dimension 690 is greater than the second dimension 692. In some examples, the first connecting structure 620 is a threaded connector. The first dimension 690 can be a width of a portion of the threaded connector, such as the distance across the faces of a nut or the head of a bolt. In FIG. 6*b*, the first connecting structure has been removed to show the second opening 688, and the first dimension 690 is shown at the second connecting structure 630 for ease of explanation. Because the first dimension 690 is greater than the second dimension 692, the first guide device 640 is prevented from falling away from the first support structure 604.

As with previous examples of the fourth support structure 510, the first support portion 604 can define a third opening, and the second guide device 670 can define a fourth opening that are similar or the same as the first opening 622 and the second opening 688. Indeed, the second connecting structure 630 is configured to pass through the third opening and the fourth opening to connect the second guide device 670 to the first support portion 604.

Returning to FIG. 6*d*, the fourth support structure 510 does not necessarily include an attachment portion as was described with previous examples. In the example shown in FIG. 6*d*, the first support portion 604 can be separated from the second support portion by the first guide device 640 and the second guide device 670. As such the first opening 622 and the second opening 632 can be contiguous and not separated by an attachment portion 608.

Figure 6E:
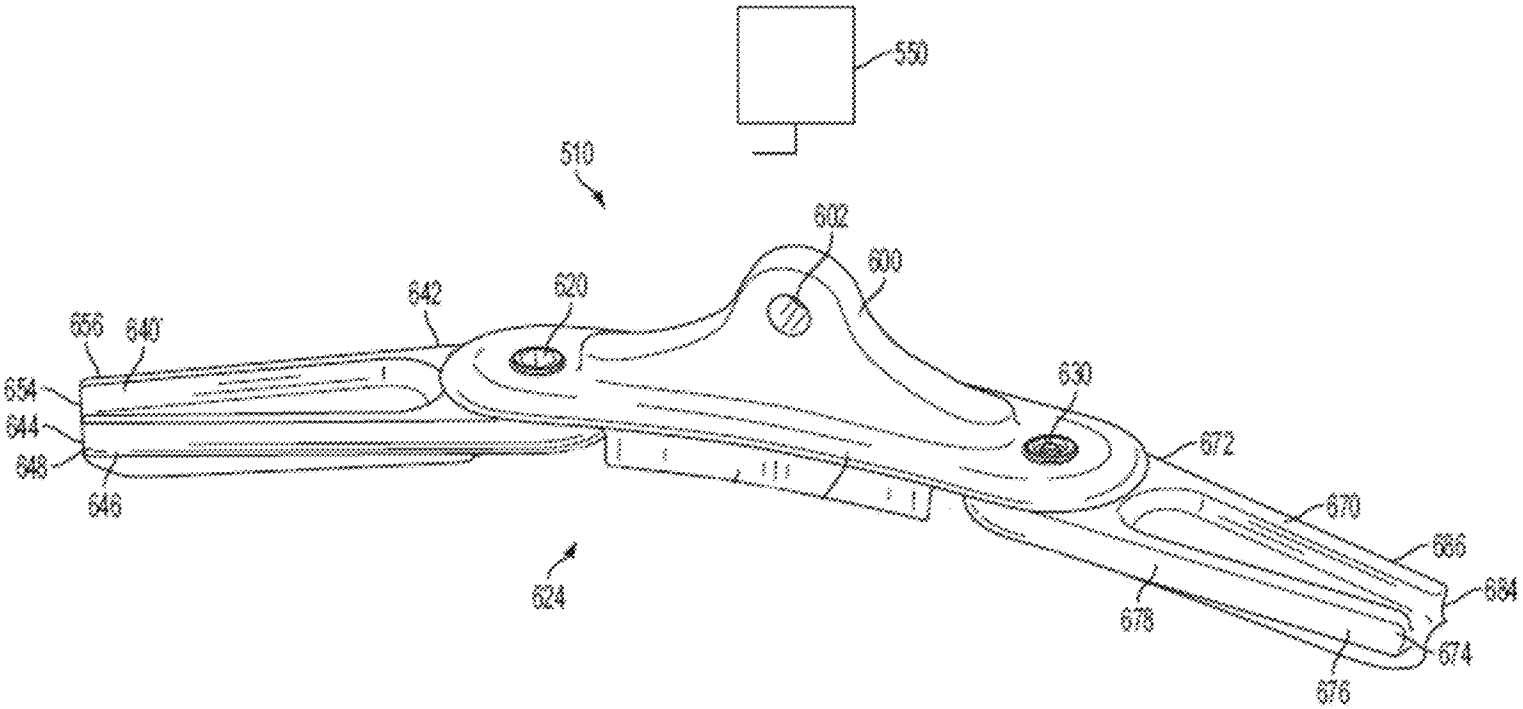
FIG. 6*e* illustrates a fourth example support structure for a bridge component.

Turning to FIG. 6*e*, another example of the fourth support device 510 is illustrated. In some examples, the second support portion 606 (shown in FIG. 6*a*) is not included. Without the second support portion 606, the first guide device 640 and the second guide device 670 attach directly to the first support portion 604 using the first and second projections or connecting structures 620, 630.

Figure 6F:
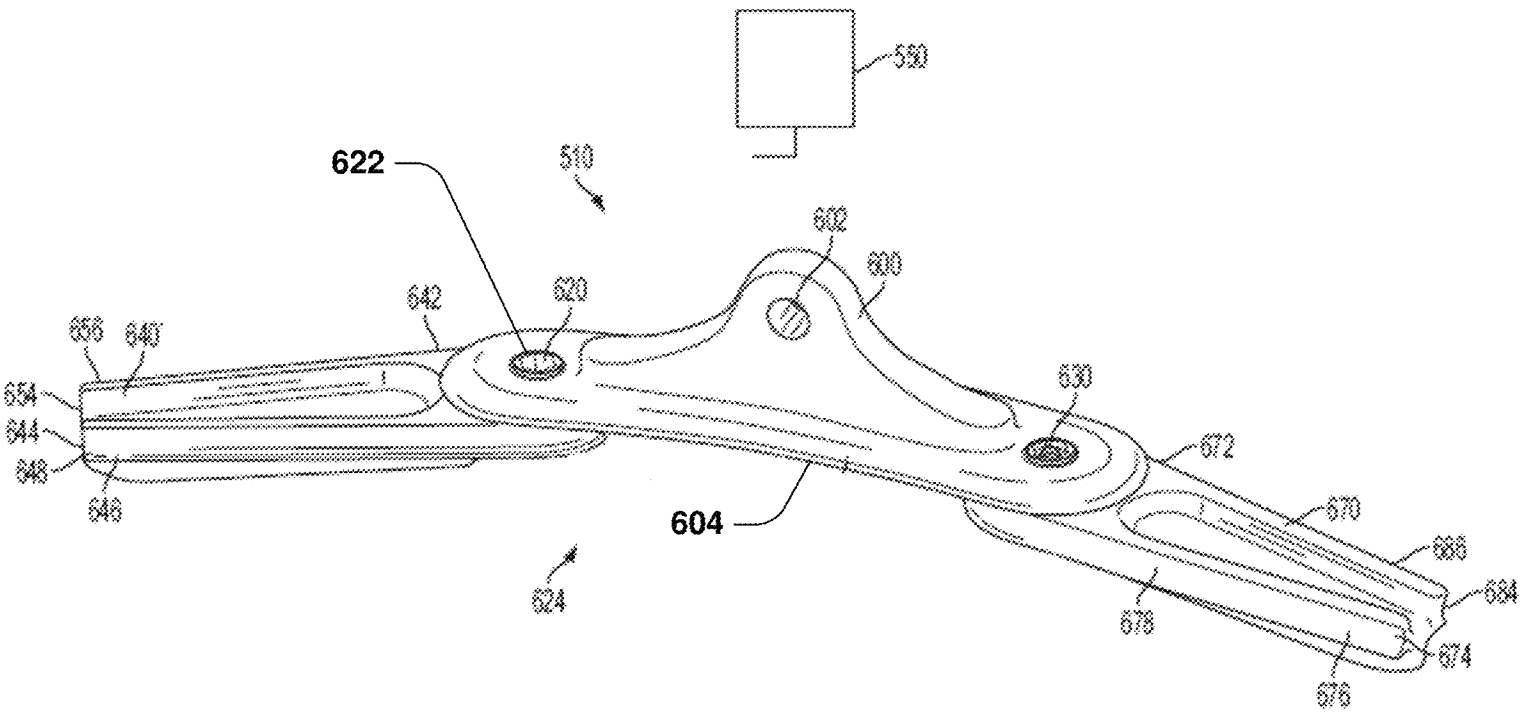
FIG. 6*f* illustrates a fourth example support structure for a bridge component.

Turning to FIG. 6*f*, another example of the fourth support device 510 is illustrated. In some examples, both the second support portion 606 (shown in FIG. 6*a*) and the attachment portion 608 (shown in FIG. 6*a*) are not included. Attachment of the first guide device 640 and the second guide device 670 and operation of these examples of the fourth support device 510 are similar to the example shown in FIG. 6*e*.

Figure 6G:
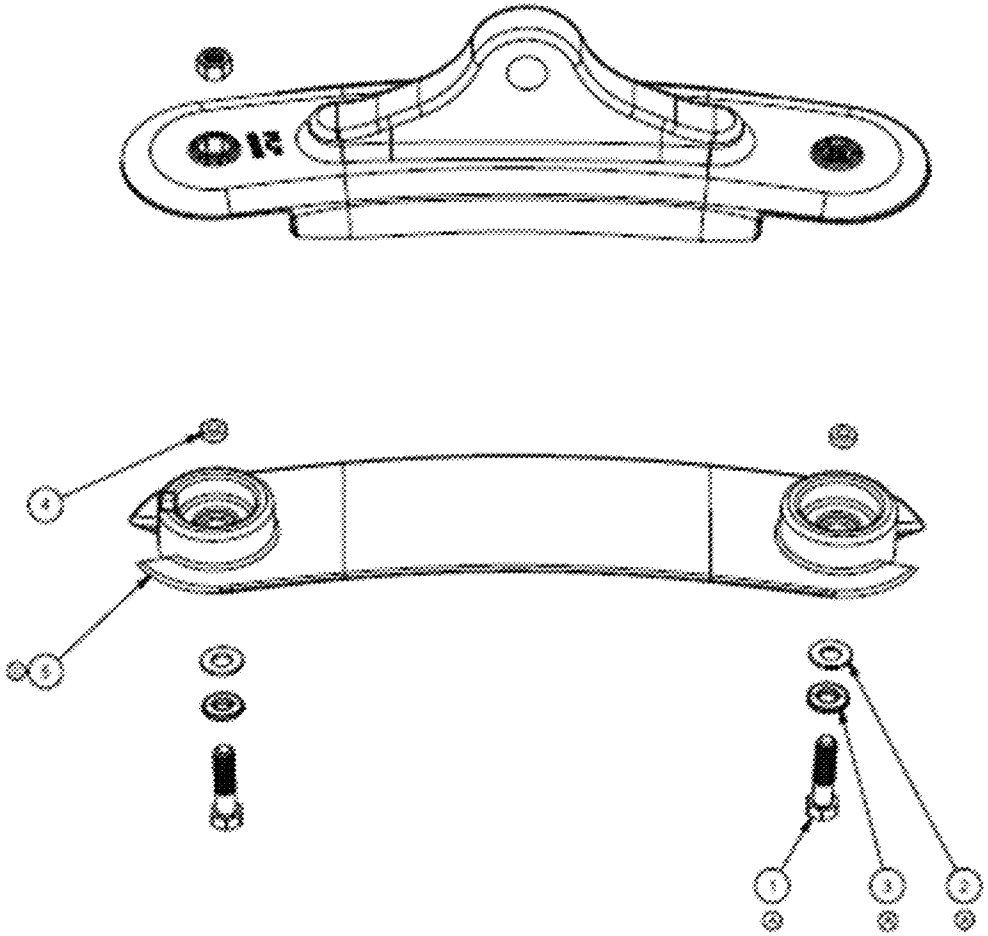
FIG. 6*g* illustrates an exploded view of a bridge component.

Turning to FIG. 6*g*, an exploded view of an example fourth support device 510 is illustrated.

Figure 7A:
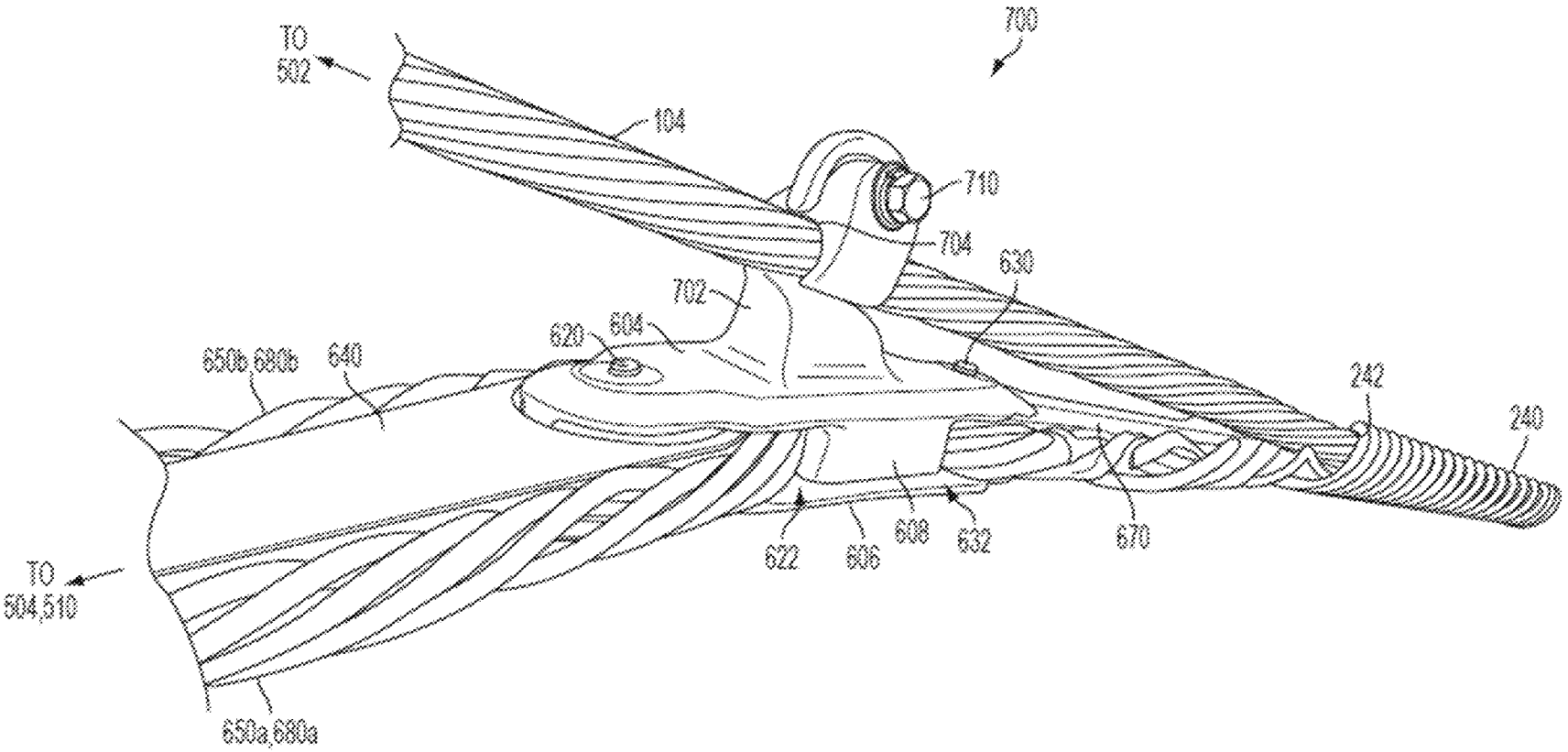
FIG. 7*a* illustrates a fifth example support structure.

Turning to FIG. 7*a*, an example of a fifth support structure 700 is illustrated. The fifth support structure 700 can be positioned in the illustrated locations of FIG. 5, for example. In an example, the fifth support structure 700 can divert the robot 102 from the shield wire 104 to the bridge 504 and/or from the bridge 504 to the shield wire 104. While FIG. 5 illustrates two examples of the fifth support structure 700, the example of the fifth support structure 700 illustrated in FIG. 7*a* is generally identical to either of the two fifth support structures 700 that are illustrated in FIG. 5. The fifth support structure 700 comprises any number of materials, including metals, plastics, composite materials, or the like. In this example, the fifth support structure 700 has at least some degree of rigidity/stiffness so as to support the guide wire 540, the robot 102, etc.

The fifth support structure 700 includes at least some structures that are identical to structures of the fourth support structure 510. For example, the fifth support structure 700 may include the first support portion 604, the second support portion 606, the attachment portion 608, the first connecting structure 620, and the second connecting structure 630. Additionally, the fifth support structure 700 may include the guide wire 540 (comprising the first wire portion 650*a* and the second wire portion 650*b*) or the second guide wire 542 (comprising the first wire portion 680*a* and the second wire portion 680*b*) received within the first opening 622 and the second guide wire 542 (comprising the first wire portion 680*a* and the second wire portion 680*b*) received within the first opening 622. The fifth support structure 700 may also include the first guide device 640 and the second guide device 670.

In the illustrated example of FIG. 7*a*, the shield wire 104 can extend from the guide wire opening 242 of the guide wire 240. The shield wire 104 can be extend (e.g., from right to left and out of the left-hand side of the page in FIG. 7*a*) to be attached to the utility structure 502 (illustrated in FIG. 5). The fifth support structure 700 can include an attachment structure 702. The attachment structure 702 can be attached to (e.g., connected, formed with, etc.) the first support portion 604. The attachment structure 702 can project outwardly (e.g., upwardly) from the first support portion 604 in a direction away from the attachment portion 608, the second support portion 606, etc.

The attachment structure 702 of the fifth support structure 700 defines a third channel 704 into which the shield wire 104 is received. In this example, the third channel 704 comprises an opening, space, gap, or the like that is sized/shaped to receive the shield wire 104. The third channel 704 and, thus, the shield wire 104, may extend in a direction that is non-parallel to a direction along which the fifth support structure 700 extends. As such, in this example, the shield wire 104 is not in-line with the fifth support structure 700 (in contrast to the example of FIG. 2), such that the fifth support structure 700 functions to divert the shield wire 104. In particular, the third channel 704 may extend upwardly towards the utility structure 502. Accordingly, the support structure 110 may pass through the robot 102 while the fifth support structure 700 does not, but, rather, diverts the robot 102 off track or off of the shield wire 104.

In some examples, the attachment structure 702 comprises a fastener 710 that allows for the third channel 704 to be selectively opened/closed. For example, the fastener 710 is configured to be loosened, for example, to allow for access to the third channel 704, such that the shield wire 104 may be inserted or removed from the third channel 704. The attachment structure 702 has at least some degree or rigidity/stiffness, such that the attachment structure 702 can hang from the shield wire 104 and support the robot 102.

In operation, the fifth support structure 700 allows for the robot 102 to be diverted to the bridge 504 from the shield wire 104. For example, the robot 102 can traverse/move along the shield wire 104 and the guide wire 240 in a right to left direction in FIG. 7*a*. The robot 102 can disengage from the shield wire 104 and is guided by the guide wire 240 towards the bridge 504. In such an example, the robot 102 (moving right to left in FIG. 7*a*) can engage and traverse along the first support portion 604 and the second support portion 606, and then along the first wire portion 650*a*, 680*a* and the second wire portion 650*b*, 680*b*.

Similarly, in operation, the fifth support structure 700 allows for the robot 102 to be diverted from the bridge 504 to the shield wire 104. For example, the robot 102 can traverse/move along the bridge 504 in a left to right direction in FIG. 7*a*. The robot 102 can engage and traverse along the first support portion 604 and the second support portion 606. The robot can continue to move (left to right in FIG. 7*a*) before engaging and holding the guide wire 240 first, and then the shield wire 104.

Figure 7B:
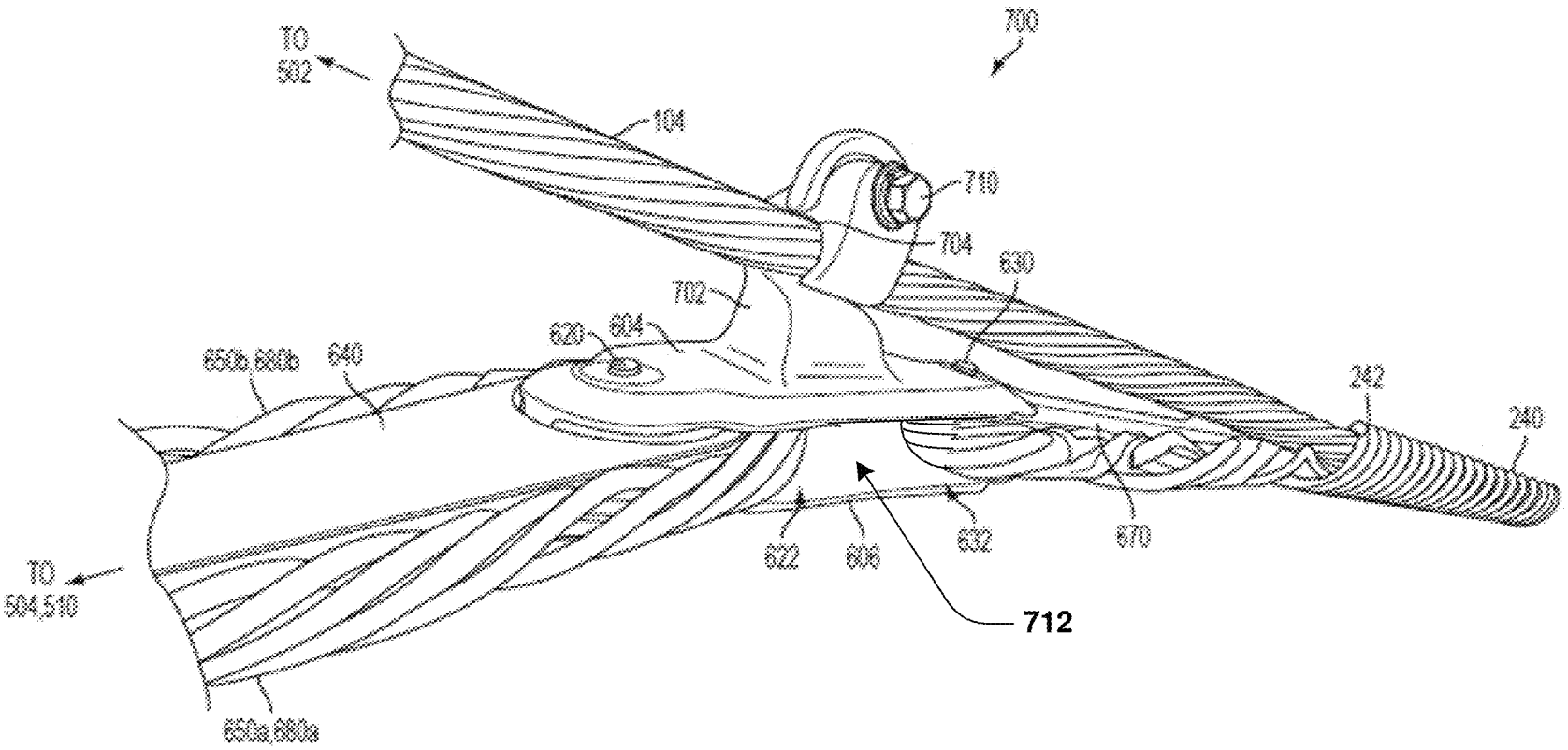
FIG. 7*b* illustrates a fifth example support structure.

Turning now to FIG. 7*b*, an example of the fifth support structure is illustrated. In these examples, the attachment portion 608 (shown in FIG. 7*a*) is not included. As such, the first opening 622 and the second opening 632 are contiguous and can form a single undivided opening 712. In the examples represented by FIG. 7*b*, the first support portion 604 can be separated from the second support portion by the first guide device 640 and the second guide device 670.

Figure 8A:
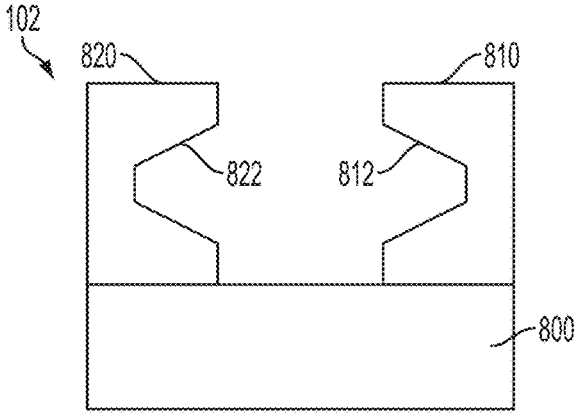
FIG. 8*a* illustrates an example robot.

Turning now to FIG. 8*a*, an example of the robot 102 is illustrated. It will be appreciated that the robot 102 is illustrated generically/schematically in FIGS. 8*a* and 8*b* because the robot 102 includes any number of sizes, structures, configurations, etc. Indeed, in other examples, the robot 102 may include additional parts/structures and/or may be more complicated than as illustrated.

The robot 102 can include a base 800. While the base 800 is illustrated as having a generally rectangular shape, other shapes are envisioned. Moreover, the base can be larger or smaller than as illustrated, and, in some examples, may have grooves, openings, channels, or the like extending therein (e.g., to accommodate for the damper device 344).

The robot 102 can include a first gripping structure 810. The first griping structure 810 may be supported by the base 800, with the first gripping structure 810 selectively movable with respect to the base 800. The first gripping structure 810 comprises any number of structures. In an example, the first gripping structure 810 may include one or more wheels, rollers, or the like. It will be appreciated that the first gripping structure 810 of FIG. 8*a* may be larger or smaller than as illustrated, and that only a portion of the first gripping structure 810 is illustrated in FIG. 8*a*.

The first gripping structure 810 can define a first channel 812. The first channel 812 defines an opening, space, recess, gap, passage, or the like in the first gripping structure 810. The first channel 812 comprises any number of sizes/shapes, and in other examples, may be larger or smaller in size than as illustrated. In general, the first channel 812 can receive and/or hold one or more items/structures therein.

The robot 102 can include a second gripping structure 820. The second gripping structure 820 may be supported by the base 800, with the second gripping structure 820 selectively movable with respect to the base 800. In the illustrated example, the second gripping structure 820 is generally identical to the first gripping structure 810. The second gripping structure 820 comprises any number of structures. In an example, the second gripping structure 820 may include one or more wheels, rollers, or the like. It will be appreciated that the second gripping structure 820 of FIG. 8*a* may be larger or smaller than as illustrated, and that only a portion of the second gripping structure 820 is illustrated in FIG. 8*a*.

The second gripping structure 820 can define a second channel 822. The second channel 822 defines an opening, space, recess, gap, passage, or the like in the second gripping structure 820. The second channel 822 comprises any number of sizes/shapes, and in other examples, may be larger or smaller in size than as illustrated. In general, the second channel 822 can receive and/or hold one or more items/structures therein.

While two gripping structures (e.g., the first gripping structure 810 and the second gripping structure 820) are illustrated in FIG. 8*a*, it will be appreciated that any number of gripping structures are envisioned. In some examples, the first gripping structure 810 may comprise a plurality of first gripping structures 810 arranged side by side (e.g., extending into and out of the page). Similarly, the second gripping structure 820 is not limited to including one second gripping structure 820, and in other examples, may comprise a plurality of second gripping structures 820 arranged side by side (e.g., extending into and out of the page). The non-illustrated, additional first gripping structures 810 may be generally identical to the illustrated first gripping structure 810. Likewise, the non-illustrated, additional second gripping structures 820 may be generally identical to the illustrated second gripping structure 820.

Figure 8B:
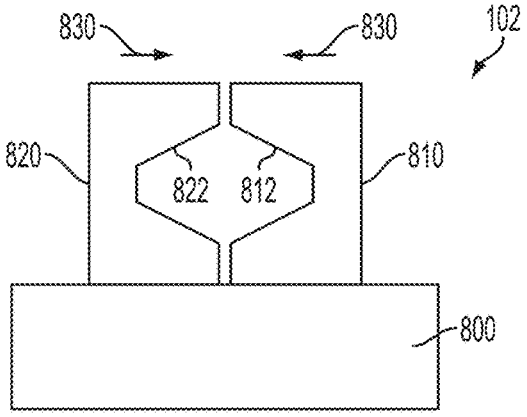
FIG. 8*b* illustrates an example robot.

Turning to FIG. 8*b*, the first gripping structure 810 and/or the second gripping structure 820 can be moved along a movement direction 830. In this example, the first gripping structure 810 may move along the movement direction 830 towards the second gripping structure 820. Likewise, the second gripping structure 820 may move along the movement direction 830 towards the first gripping structure 810. By moving the first gripping structures 810, 820 in the movement direction 830, the first channel 812 and the second channel 822 are brought closer together. As such, items (e.g., guide wire(s), shield wire, etc.) can be received and held within the first channel 812 and the second channel 822.

Turning to FIG. 9*a*, an example of the robot 102 gripping the guide wire 240 (or the guide wire 540, the second guide wire 542, etc.) is illustrated. It will be appreciated that the respective dimensions of the robot 102, the guide wire 240, the shield wire 104, etc. are not drawn to scale. Rather, FIG. 9*a* is merely intended to illustrate an example of the robot 102 engaging the guide wire 240 (or the guide wire 540, the second guide wire 542, etc.), the shield wire 104, etc. In operation, however, the robot 102, in particular the first gripping structure 810 and/or the second gripping structure 820, may contact/touch the guide wire 240 (or the guide wire 540, the second guide wire 542, etc.).

FIG. 9*a* illustrates positions of the robot 102 along lines 9*a*-9*a* in FIGS. 2*a* and 3*b*, for example. In these examples, the first gripping structure 810 and the second gripping structure 820 can be moved towards each other (e.g., along the movement direction 830). As such, the first channel 812 and the second channel 822 define an internal space into which the guide wire 240, which receives the shield wire 104, is received.

The robot 102 can move (e.g., into and/or out of the page) while traversing the shield wire 104. As the robot 102 encounters the guide wire 240 (as illustrated in FIG. 9*a*), the guide wire 240 (which receives the shield wire 104 therein) can be received within the first channel 812 and the second channel 822. The guide wire 240 is therefore dimensioned to facilitate disengagement of the robot 102 from the shield wire 104 and engagement of the robot 102 with the guide wire 240. For example, the guide wire 240 has a cross-sectional shape that generally matches the cross-sectional shape of the shield wire 104, with the guide wire 240 receiving the shield wire 104 therein.

Turning to FIG. 9*b*, positions of the robot 102 along lines 9*b*-9*b* of FIGS. 2*a* and 3*b* are illustrated. FIG. 9*b* further illustrates the guide wire 240 being dimensioned to facilitate disengagement of the robot 102 from the shield wire 104 and engagement of the robot 102 with the guide wire 240. For example, as the robot 102 continues to move along the guide wire 240 (e.g., into/out of the page), the guide wire 240 can split into two portions: the first wire portion 244 and the second wire portion 246. The shield wire 104 is positioned between the first wire portion 244 and the second wire portion 246.

As the robot 102 moves along the guide wire 240 between the positions illustrated in FIGS. 9*a* and 9*b*, the first gripping structure 810 and the second gripping structure 820 may be moved apart (e.g., in a direction opposite the movement direction 830). This movement of the first gripping structure 810 and the second gripping structure 820 is caused by the guide wire 240 separating to form the first wire portion 244 and the second wire portion 246. Indeed, the first wire portion 244, positioned in the first channel 812, causes the first gripping structure 810 to move outwardly while the second wire portion, positioned in the second channel 822, causes the second gripping structure 820 to move outwardly. As such, the guide wire 240 is dimensioned, such as by splitting into the first wire portion 244 and the second wire portion 246, to further facilitate disengagement of the robot 102 from the shield wire 104 and engagement of the robot 102 with the guide wire 240 (e.g., with the first wire portion 244 and the second wire portion 246).

In this and the following examples, the robot 102, in particular the first gripping structure 810 and the second gripping structure 820, has at least some degree of gripping force to maintain the robot 102 in association with the shield wire 104, the guide wire 240, etc. For example, the first gripping structure 810 and the second gripping structure 820 have a gripping force directed along the movement direction 830 such that the first gripping structure 810 and the second gripping structure 820 can sandwich and hold any structures therewithin. In an example, the first gripping structure 810 is biased towards the second gripping structure 820 while the second gripping structure 820 is biased towards the first gripping structure 810. As such, the robot 102 is generally limited from inadvertently falling off and/or becoming dislodged from the shield wire 104, the guide wire 240, etc.

Turning to FIG. 9*c*, positions of the robot 102 along lines 9*c*-9*c* of FIGS. 2*a* and 3*b* are illustrated. FIG. 9*c* further illustrates the robot 102 traversing the support structure 110 or the second support structure 300, for example. In this example, the first wire portion 244 is positioned within the first channel 210 of the support structure 110 or the first channel 310 of the second support structure 300. The second wire portion 246 is positioned within the second channel 220 of the support structure 110 or the second channel 310 of the second support structure 300.

In this example, the first channel 210, 310 may be dimensioned to further facilitate disengagement of the robot 102 from the shield wire 104. For example, the robot 102 may move along the shield wire 104 (e.g., before FIG. 9*a*) and then may move along the guide wire 240 (e.g., first wire portion 244 and the second wire portion 246). Due to the first wire portion 244 being positioned in the first channel 210, 310, the first channel 812 of the first gripping structure 810 can receive the first wire portion 244 and, in some examples, a portion of the support structure 101 or the second support structure 300. As such, the first channel 210 of the support structure 110 and the first channel 310 of the second support structure 300 are dimensioned to facilitate engagement of the robot 102 with the first wire portion 244.

Likewise, in this example, the second channel 220, 320 may be dimensioned to further facilitate disengagement of the robot 102 from the shield wire 104. For example, due to the second wire portion 246 being positioned in the second channel 220, 320, the second channel 822 of the second gripping structure 820 can receive the second wire portion 246 and, in some examples, a portion of the support structure 101 or the second support structure 300. As such, the second channel 220 of the support structure 110 and the second channel 320 of the second support structure 300 are dimensioned to facilitate engagement of the robot 102 with the second wire portion 246.

In this example, the robot 102 can engage (e.g., grip, hold, etc.) the first wire portion 244 and, in some examples, a portion of the support structure 101 or the second support structure 300. Likewise, the robot 102 can engage (e.g., grip, hold, etc.) the second wire portion 246 and, in some examples, a portion of the support structure 101 or the second support structure 300. As such, the robot 102 can traverse the support structure 110 and/or the second support structure 300.

Turning to FIG. 9*d*, a position of the robot 102 along lines 9*d*-9*d* of FIG. 6*c* is illustrated. It will be appreciated that since the fourth support structure 510 of FIG. 6*c* is similar and/or identical in some respects to the fifth support structure 700 of FIG. 7*a*, that the illustrated position of the robot 102 with respect to the fourth support structure 510 in FIG. 9*d* may also be representative of the fifth support structure 700.

In this example, the first wire portion 650*a*, 680*a* is positioned in the first channel 646, 676 of the first guide device 640 or the second guide device 670. The second wire portion 650*b*, 680*b* may be positioned in the second channel 654, 684 of the first guide device 640 or the second guide device 670. As with the previous examples, the first channel 646, 676 is dimensioned to facilitate engagement of the robot 102 with the first wire portion 650*a*, 680*a*. For example, the first gripping structure 810 can receive the first wire portion 650*a*, 680*a* within the first channel 812. The robot 102 can traverse the first wire portion 650*a*, 680*a* by moving along the guide wire 540, 542 (e.g., into and out of the page).

Likewise, in some examples, the second channel 654, 684 is dimensioned to facilitate engagement of the robot 102 with the second wire portion 650*b*, 680*b*. For example, the second gripping structure 820 can receive the second wire portion 650*b*, 680*b* within the second channel 822. The robot 102 can traverse the second wire portion 650*b*, 680*b* by moving along the guide wire 540, 542 (e.g., into and out of the page). The robot 102 can then traverse the fourth support structure 510 by receiving portions of the fourth support structure 510 within the first channel 812 and the second channel 822, such that the robot 102 engages (e.g., grips, holds, receives) edges of the fourth support structure 510.

Turning to FIG. 9*e*, a position of the robot 102 along lines 9*e*-9*e* of FIG.4 is illustrated. In this example, the first support portion 420 is dimensioned to facilitate disengagement of the robot 102 from the first support portion 420 and engagement of the robot 102 with the first support edge 404 and the second support edge 406 of the body 401 of the third support structure 400. The first channel 812 of the first gripping structure 810 and the second channel 822 of the second gripping structure 820 can engage (e.g., grip, hold, receive, etc.) the first support portion 420.

As the robot 102 traverses the first support portion 420 and moves towards the body 401 of the third support structure 400, the robot 102 can disengage from the first support portion 420. In this example, the first support portion 420 may be dimensioned to match a cross-sectional shape of the body 401 of the third support structure 400. As such, the robot 102 can engage the body 401 of the third support structure 400, such as by receiving the first support edge 404 within the first channel 812 and the second support edge 406 within the second channel 822.

The second support portion 430 is dimensioned to facilitate disengagement of the robot 102 from the first support edge 404 and the second support edge 406 of the body 401 and engagement of the robot 102 with the second support portion 430. In this example, the second support portion 430 may be dimensioned to match the cross-sectional shape of the body 401 of the third support structure 400. As such, the robot 102 can disengage from the first support edge 404 within the first channel 812 and the second support edge 406 within the second channel 822. The robot 102 can then engage the second support portion 430, such as by receiving edge portions of the second support portion 430 within the first channel 812 and the second channel 822.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first cover portion and a second cover portion generally correspond to cover portion A and cover portion B or two different or two identical cover portions or the same cover portion.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims.

What is claimed is:

1. A line bypass system comprising:

a support structure comprising:

a first support portion defining a first opening;

a first guide device defining a second opening;

a first connecting structure configured to pass through the first opening and the second opening to connect the first guide device to the first support portion, wherein the first guide device defines a first channel into which a first wire portion of a first guide wire is received and the first channel extends a distance in a direction substantially parallel to a direction along which the first guide wire extends; and an attachment structure configured to attach to a suspension device such that the support structure is supported below the suspension device, wherein:

the first connecting structure extends in a second direction to pass through the first opening and the second opening; and the first support portion is disposed between the attachment structure and the first guide device along the second direction when the attachment structure is attached to the suspension device.

2. The line bypass system of claim 1, wherein the first connecting structure has a first dimension, the second opening has a second dimension, and the first dimension is greater than the second dimension.

3. The line bypass system of claim 1, wherein the first connecting structure is a threaded connector.

4. The line bypass system of claim 1, wherein the first support portion defines a third opening, and the line bypass system comprises:

a second guide device defining a fourth opening; and a second connecting structure configured to pass through the third opening and the fourth opening to connect the second guide device to the first support portion, wherein the second guide device defines a first channel into which a first wire portion of a second guide wire is received and the first channel extends a distance in a direction substantially parallel to a direction along which the second guide wire extends.

5. The line bypass system of claim 1, comprising a second support portion defining a fifth opening, the second support portion separated a distance from the first support portion, the first connecting structure configured to pass through the fifth opening to connect the second support portion to the first support portion.

6. The line bypass system of claim 5, wherein the first support portion and the second support portion define an opening configured to movably receive the first guide device.

7. A line bypass system comprising:

a support structure defining a first channel, into which a first section of a first wire portion of a guide wire is received, and a second channel, into which a first section of a second wire portion of the guide wire is received;

a second support structure defining a third channel, into which a second section of the first wire portion is received, and a fourth channel, into which a second section of the second wire portion is received; and a third support structure disposed between the support structure and the second support structure in a direction along which the guide wire extends, wherein:

the support structure, the second support structure, and the third support structure are separately made elements;

the support structure extends from a first end surface to a second end surface;

the second support structure extends from a first end surface to a second end surface;

the third support structure extends from a first end surface to a second end surface;

the first end surface of the support structure is adjacent to and faces the first end surface of the third support structure once the line bypass system is assembled; and the first end surface of the second support structure is adjacent to and faces the second end surface of the third support structure once the line bypass system is assembled.

8. The line bypass system of claim 7, wherein the fourth channel extends non-parallel to the third channel.

9. The line bypass system of claim 7, wherein the second section of the first wire portion is contiguous with the first section of the first wire portion.

10. The line bypass system of claim 7, wherein the second section of the second wire portion is contiguous with the first section of the second wire portion.

11. The line bypass system of claim 7, wherein the support structure defines the first channel along a first side of the support structure and the support structure defines the second channel along an opposing second side of the support structure.

12. The line bypass system of claim 7, wherein at least one of the support structure or the second support structure define a fifth channel into which a first section of a shield wire is received.

13. The line bypass system of claim 12, wherein at least one of the support structure or the second support structure comprises a fin configured to limit rotation of a robot traversing the shield wire.

14. A line bypass system comprising:

an attachment structure configured to attach the line bypass system to a suspension device; and a first guide device coupled to the attachment structure and extending from a first end to a second end, wherein:

the first guide device defines a first channel into which a first wire portion of a first guide wire is received, the first guide device defining the first channel as an arc having a middle portion between a first end portion and a second end portion, wherein:

the first end portion of the arc is proximate the first end of the first guide device, the second end portion of the arc is proximate the second end of the first guide device, the middle portion of the arc is higher than the first end portion of the arc such that, when the line bypass system is attached to the suspension device, a first distance between the middle portion of the arc and an elevation of the suspension device is less than a second distance between the first end portion of the arc and the elevation of the suspension device, the middle portion of the arc is higher than the second end portion of the arc such that, when the line bypass system is attached to the suspension device, the first distance between the middle portion of the arc and the elevation of the suspension device is less than a third distance between the second end portion of the arc and the elevation of the suspension device.

15. The line bypass system of claim 14, wherein the first guide device defines a second channel into which a second wire portion of the first guide wire is received, the first channel is defined along a first side of the first guide device, and the second channel is defined along an opposing second side of the first guide device.

16. The line bypass system of claim 15, wherein the second channel and the first channel taper into each other such that the first guide wire engages a shield wire extending from a shield wire channel defined by the first guide device.

17. A line bypass system comprising:

a support structure comprising:

a mid-section;

a first flange to a first side of the mid-section, the first flange extending along a first flange axis;

a second flange to a second side of the mid-section, the second side opposite the first side relative to the mid-section, the second flange extending along a second flange axis, the first flange axis not parallel to the second flange axis, the first flange axis and the second flange axis lying within a first plane;

a first projection projecting from the first flange, wherein a first opening is defined between the mid-section and the first projection, the first opening configured to movably receive a first guide wire; and a second projection projecting from the second flange, wherein a second opening is defined between the mid-section and the second projection, the second opening configured to movably receive a second guide wire, wherein:

the first guide wire extends away from the support structure in a direction defined by a line drawn from the mid-section to the first flange, the second guide wire extends away from the support structure in a second direction defined by a line drawn from the mid-section to the second flange, and the first flange, the mid-section, and the second flange are arranged so as to define a horizontal arc that lies within a second plane parallel to the first plane.

18. The line bypass system of claim 17, comprising an attachment structure configured to attach to a suspension device such that the support structure is supported below the suspension device.

19. The line bypass system of claim 17, wherein:

the first flange axis extends parallel the line drawn from the mid-section to the first flange, and the second flange axis extends parallel the line drawn from the mid-section to the second flange.

20. The line bypass system of claim 17, comprising:

a third flange to the first side of the mid-section; and a fourth flange to the second side of the mid-section, wherein:

the first flange and the third flange define a third opening to receive a first guide device for the first guide wire, and the second flange and the fourth flange define a fourth opening to receive a second guide device for the second guide wire.

* * * * *